US006092610A

United States Patent [19]

Kosmala et al.

[11] Patent Number: 6,092,610

[45] Date of Patent: Jul. 25, 2000

[54] ACTIVELY CONTROLLED ROTARY STEERABLE SYSTEM AND METHOD FOR DRILLING WELLS

[75] Inventors: Alexandre G. E. Kosmala, Houston; Attilio C. Pisoni, Sugar Land; Dimitrios K. Pirovolou; Spyro J. Kotsonis, both of Houston, all of Tex.

[73] Assignee: Schlumberger Technology Corporation, Sugar Land, Tex.

[21] Appl. No.: 09/019,468

[22] Filed: Feb. 5, 1998

[51] Int. Cl.[7] ..... E21B 7/04

[52] U.S. Cl. ..... 175/61; 175/73; 175/27

[58] Field of Search ..... 175/61, 73, 27

[56] References Cited

U.S. PATENT DOCUMENTS

| | | |
|---|---|---|
| Re. 33,751 | 11/1991 | Geczy et al. . |
| 2,319,236 | 5/1943 | Isaacks et al. . |
| 2,687,282 | 8/1954 | Sanders . |
| 2,694,549 | 11/1954 | James . |
| 2,876,992 | 3/1959 | Lindsay . |

FOREIGN PATENT DOCUMENTS

| | | |
|---|---|---|
| 0 343 800 A2 | 11/1989 | European Pat. Off. . |
| 0 520 733 A1 | 12/1992 | European Pat. Off. . |
| 0 530 045 A1 | 3/1993 | European Pat. Off. . |
| 0 744 526 A1 | 11/1996 | European Pat. Off. . |
| 2 172 324 B | 9/1986 | United Kingdom . |
| 2 172 325 B | 9/1986 | United Kingdom . |
| 2 177 738 B | 1/1987 | United Kingdom . |
| 2 246 151 A | 1/1992 | United Kingdom . |
| 9631679 | 10/1996 | WIPO . |

(List continued on next page.)

OTHER PUBLICATIONS

Anadrill Schlumberger Brochure, Anadrill Tightens Directional Control with Downhole–Adjustable Stabilizers, no date.

Baker Hughes Inteq. "Rotary Directional Drilling System Enhances Steering with Less Torque and Drag", *Hart's Petroleum Engineer International,* Apr. 1997, p. 30.

Barr, J.D., et al., "Steerable Rotary Drilling With an Experimental System", SPE/IADC 29382, presented at the 1995 SPE/IADC Drilling Conference, Amsterdam, The Netherlands, Feb. 28–Mar. 2, 1995, 16 pages.

(List continued on next page.)

*Primary Examiner*—Eileen Dunn Lillis
*Assistant Examiner*—Sunil Singh
*Attorney, Agent, or Firm*—James L. Jackson; Wayne I. Kanak; Steven L. Christian

[57] ABSTRACT

An actively controlled rotary steerable drilling system for directional drilling of wells having a tool collar rotated by a drill string during well drilling. A bit shaft has an upper portion within the tool collar and a lower end extending from the collar and supporting a drill bit. The bit shaft is omnidirectionally pivotally supported intermediate its upper and lower ends by a universal joint within the collar and is rotatably driven by the collar. To achieve controlled steering of the rotating drill bit, orientation of the bit shaft relative to the tool collar is sensed and the bit shaft is maintained geostationary and selectively axially inclined relative to the tool collar during drill string rotation by rotating it about the universal joint by an offsetting mandrel that is rotated counter to collar rotation and at the same frequency of rotation. An electric motor provides rotation to the offsetting mandrel with respect to the tool collar and is servo-controlled by signal input from position sensing elements such as magnetometers, gyroscopic sensors, and accelerometers which provide real time position signals to the motor control. In addition, when necessary, a brake is used to maintain the offsetting mandrel and the bit shaft axis geostationary. Alternatively, a turbine is connected to the offsetting mandrel to provide rotation to the offsetting mandrel with respect to the tool collar and a brake is used to servo-control the turbine by signal input from position sensors.

69 Claims, 15 Drawing Sheets

U.S. PATENT DOCUMENTS 3,068,946 12/1962 Frisby et al. .
3,098,534 7/1963 Carr et al. .
3,370,657 2/1968 Antle .
3,457,999 7/1969 Massey .
3,561,549 2/1971 Garrison .
3,575,247 4/1971 Feenstra .
3,637,032 1/1972 Jeter .
3,667,556 6/1972 Henderson .
3,743,034 7/1973 Bradley .
3,799,279 3/1974 Farris .
3,878,903 4/1975 Cherrington .
3,903,974 9/1975 Cullen .
4,040,494 8/1977 Kellner .
4,040,495 8/1977 Kellner et al. .
4,076,084 2/1978 Tighe .
4,080,115 3/1978 Sims et al. .
4,184,553 1/1980 Jones, Jr. et al. .
4,185,704 1/1980 Nixon, Jr. .
4,211,292 7/1980 Evans .
4,220,213 9/1980 Hamilton .
4,291,773 9/1981 Evans .
4,305,474 12/1981 Farris et al. .
4,416,339 11/1983 Baker et al. .
4,428,441 1/1984 Dellinger .
4,449,595 5/1984 Holbert .
4,456,080 6/1984 Holbert .
4,461,359 7/1984 Jones, Jr. et al. .
4,465,147 8/1984 Feenstra et al. .
4,492,276 1/1985 Kamp .
4,523,652 6/1985 Schuh .
4,560,013 12/1985 Beimgraben .
4,635,736 1/1987 Shirley .
4,637,479 1/1987 Leising .
4,638,873 1/1987 Welborn .
4,662,458 5/1987 Ho .
4,667,751 5/1987 Geczy et al. .
4,697,651 10/1987 Dellinger .
4,699,224 10/1987 Burton .
4,714,118 12/1987 Baker et al. .
4,732,223 3/1988 Schoeffler et al. .
4,739,843 4/1988 Burton .
4,807,708 2/1989 Forrest et al. .
4,811,798 3/1989 Falgout, Sr. et al. .
4,821,815 4/1989 Baker et al. .
4,836,301 6/1989 Van Dongen et al. .
4,848,490 7/1989 Anderson .
4,858,705 8/1989 Thiery .
4,867,255 9/1989 Baker et al. .
4,880,067 11/1989 Jelsma .
4,895,214 1/1990 Schoeffler .
4,901,804 2/1990 Thometz et al. .
4,938,298 7/1990 Rehm .
4,947,944 8/1990 Coltman et al. .
4,948,925 8/1990 Winters et al. .
4,951,760 8/1990 Cendre et al. .
4,995,465 2/1991 Beck et al. .
5,050,692 9/1991 Beimgraben .
5,052,501 10/1991 Wenzel et al. .
5,103,919 4/1992 Warren et al. .
5,113,953 5/1992 Noble .
5,117,927 6/1992 Askew .
5,131,479 7/1992 Boulet et al. .
5,139,094 8/1992 Prevedel et al. .
5,163,521 11/1992 Pustanyk et al. .
5,213,168 5/1993 Warren et al. .
5,220,963 6/1993 Patton .
5,265,682 11/1993 Russell et al. .
5,265,687 11/1993 Gray .
5,305,830 4/1994 Wittrisch .
5,305,838 4/1994 Pauc .
5,311,952 5/1994 Eddison et al. .
5,311,953 5/1994 Walker .
5,316,093 5/1994 Morin et al. .
5,325,714 7/1994 Lende et al. .
5,332,048 7/1994 Underwood et al. .
5,343,966 9/1994 Wenzel et al. .
5,375,098 12/1994 Malone et al. .
5,410,303 4/1995 Comeau et al. .
5,421,420 6/1995 Malone et al. .
5,467,834 11/1995 Hughes et al. .
5,484,029 1/1996 Eddison .
5,520,256 5/1996 Eddison .
5,529,133 6/1996 Eddison .
5,594,343 1/1997 Clark et al. .
5,602,541 2/1997 Comeau et al. .
5,617,926 4/1997 Eddison et al. .
5,738,178 4/1998 Williams et al. ..... 175/61

OTHER PUBLICATIONS

Bell, S., "Automated rotary steerable tool passes test", *World Oil,* Dec. 1996, p. 31.

Colebrook, M.A., et al., "Application of Steerable Rotary Drilling Technology to Drill Extended Reach Wells", IADC/SPE 39327, presented at the 1998 IADC/SPE Drilling Conference, Dallas, Texas, Mar. 3–6, 1998, 11 pages.

Oppelt, J., et al., "Rotary Steerable Drilling System: Status of Development", *Current Issues in Drilling Technology,* GEOPEC, Aberdeen, UK, Sep. 18 and 19, 1996.

Rich, G., et al., "Rotary Closed Loop Drilling System Designed For The Next Millennium", *Hart's Petroleum Engineer International,* May 1997, pp. 47–53.

Warren, T.M., "Trends toward rotary steerable directional systems", *World Oil,* May 1997, pp. 43–47.

ACTIVELY CONTROLLED ROTARY STEERABLE SYSTEM AND METHOD FOR DRILLING WELLS

BACKGROUND OF THE INVENTION

1. Field of the Invention

This invention relates generally to methods and apparatus for drilling wells, particularly wells for the production of petroleum products, and more specifically concerns an actively controlled rotary steerable drilling system that can be connected directly to a rotary drill string or can be connected in a rotary drill string in assembly with a mud motor and/or thruster and/or flexible sub to enable selective decoupling of the actively controlled rotary steerable drilling system from the rotary drill string, such as for mud motor powered drilling, with or without drill string rotation, and to enable precision control of the direction of a bore being drilled by a drill bit and precision control of the rotary speed, torque and weight on bit being imparted to the drill bit. For mud motor speed and torque control, a controllable dump valve is provided in the fluid circuitry of the mud motor to controllably dump or divert a portion of the drilling fluid flow from the fluid circuit of the mud motor to the annulus or to bypass a portion of the drilling fluid flow past the rotor of the mud motor. This mud motor dump or bypass control valve can be automatically operated responsive to sensor signals from the rotary steerable drilling system or can be operated responsive to signals from the surface or both. For controlling weight on bit a drilling fluid powered thruster is provided in the drill string and is located above or below the rotary steerable drilling system. The thruster has a similarly controllable dump or bypass valve in its drilling fluid circuitry which is selectively adjustable by the control circuitry of the rotary steerable drilling system for the purpose of controlling the downward mechanical force, i.e., weight of the drill bit against the formation being drilled. The dump or bypass valves of the mud motor and thruster are thus both independently controlled downhole by the control system of the rotary steerable drilling tool responsive to feedback signals from various sensors and can be selectively controlled by telemetry from the surface as well. This invention also concerns an actively controlled rotary steerable drilling system incorporating a turbine powered electric motor drive mechanism for geostationary positioning of a drill bit during its rotation by the rotary drill string, mud motor, or both and having the capability for selective employment of the electric motor as a brake when the torque of the bit/formation interaction is prevalent as compared to internal friction.

2. Description of the Related Art

An oil or gas well often has a subsurface section that is drilled directionally, i.e., inclined at an angle with respect to the vertical and with the inclination having a particular compass heading or azimuth. Although wells having deviated sections may be drilled at any desired location, such as for "horizontal" borehole orientation or deviated branch bores from a primary borehole, for example, a significant number of deviated wells are drilled in the marine environment. In such case, a number of deviated wells are drilled from a single offshore production platform in a manner such that the bottoms of the boreholes are distributed over a large area of a producing horizon over which the platform is typically centrally located and wellheads for each of the wells are located on the platform structure.

Whether well drilling is being done on land or in a marine environment, there exists a present need in well drilling activities for extended reach drilling, which is accomplished according to the teachings of the present invention by achieving better transfer of weight and torque to the drill bit during drilling operations. High performance/power drilling is also achieved by the present invention by causing good transfer of weight and torque to the drill bit being controlled by the rotary steerable drilling system set forth in detail below. In circumstances where the well being drilled is of complex trajectory, the capability provided by the rotary steerable drilling system of this invention to steer the drill bit while the drill bit is being rotated by the collar of the tool enables drilling personnel to readily navigate the wellbore from one subsurface oil reservoir to another. The rotary steerable drilling tool enables steering of the wellbore both from the standpoint of inclination and from the standpoint of azimuth so that two or more subsurface zones of interest can be controllably intersected by the wellbore being drilled.

A typical procedure for drilling a directional borehole is to remove the drill string and drill bit by which the initial, vertical section of the well was drilled using conventional rotary drilling techniques, and run in at the lower end of the drill string a mud motor having a bent housing which drives the bit in response to circulation of drilling fluid. The bent housing provides a bend angle such that the axis below the bend point, which corresponds to the rotation axis of the bit, has a "toolface" angle with respect to a reference, as viewed from above. The toolface angle, or simply "toolface", establishes the azimuth or compass heading at which the deviated borehole section will be drilled as the mud motor is operated. After the toolface has been established by slowly rotating the drill string and observing the output of various orientation devices, the mud motor and drill bit are lowered, with the drill string non-rotatable to maintain the selected toolface, and the drilling fluid pumps, "mud pumps", are energized to develop fluid flow through the drill string and mud motor, thereby imparting rotary motion to the mud motor output shaft and the drill bit that is fixed thereto. The presence of the bend angle causes the bit to drill on a curve until a desired borehole inclination has been established. To drill a borehole section along the desired inclination and azimuth, the drill string is then rotated so that its rotation is superimposed over that of the mud motor output shaft, which causes the bend section to merely orbit around the axis of the borehole so that the drill bit drills straight ahead at whatever inclination and azimuth have been established. If desired, the same directional drilling techniques can be used as the maximum depth of the wellbore is approached to curve the wellbore to horizontal and then extend it horizontally into or through the production zone. Measurement-while-drilling "MWD" systems commonly are included in the drill string above the mud motor to monitor the progress of the borehole being drilled so that corrective measures can be instituted if the various borehole parameters indicate variance from the projected plan.

Various problems can arise when sections of the well are being drilled with the drill string non-rotatable and with a mud motor being operated by drilling fluid flow. The reactive torque caused by operation of a mud motor can cause the toolface to gradually change so that the borehole is not being deepened at the desired azimuth. If not corrected, the wellbore may extend to a point that is too close to another wellbore, the wellbore may miss the desired "subsurface target", or the wellbore may simply be of excessive length due to "wandering". These undesirable factors can cause the drilling costs of the wellbore to be excessive and can decrease the drainage efficiency of fluid production from a subsurface formation of interest. Moreover, a non-rotating drill string may cause increased frictional drag so that there is less control over the "weight on bit" and the rate of drill bit penetration can decrease, which can result in substantially increased drilling costs. Of course, a non-rotating drill string is more likely to get stuck in the wellbore than a rotating one, particularly where the drill string extends through a permeable zone that causes significant build up of mud cake on the borehole wall.

Two patents of interest to the subject matter of the present invention are U.S. Pat. Nos. 5,113,953 and 5,265,682. The '953 patent presents a directional drilling apparatus and method in which the drill bit is coupled to the lower end of a drill string through a universal joint, and the bit shaft is pivotally rotated within the steerable drilling tool collar at a speed which is equal and opposite to the rotational speed of the drill string. The present invention is significantly advanced as compared to the subject matter of the '953 patent in that the angle of the bit shaft or mandrel relative to the drill collar of the present invention is variable rather than being fixed. Additionally, the provision of a braking system (electrical, mechanical or hydraulic) in the rotary steerable drilling tool of the present invention is another significant advance over the teachings of the prior art. Even further, the presence of various position measurement systems and position signal responsive control in the rotary steerable drilling system of the present invention distinguishes it from the prior art. The present invention is also distinguished from the teachings of the prior art in the assembly of drilling system controllable mud motor and thruster apparatus and a flexible sub that can be arranged in any suitable assembly to enable directionally controlled drilling to be selectively powered by the rotary drill string, the mud motor, or both, and to provide for precision control of weight on bit and accuracy of drill bit orientation during drilling.

The '682 patent presents a system for maintaining a downhole instrumentation package in a roll stabilized orientation by means of an impeller. The roll stabilized instrumentation is used for modulating fluid pressure to a set of radial pistons which are sequentially activated to urge the bit in a desired direction. The drill bit steering system of the '682 patent most notably differs from the concept of the present invention in the different means that is utilized for deviating the drill bit in the desired direction. Namely, the '682 patent describes a mechanism which uses pistons to force the bit in a desired lateral direction within the borehole. In contrast, the rotary steerable drilling system of the present invention keeps the drill bit pointing in a desired borehole direction, despite rotation of the drill collar, by utilizing an impeller to drive an alternator, the output of which drives an electric motor to rotate the bit shaft axis about a universal joint at the same rotational frequency as the bit shaft is driven in rotary manner by the tool collar. The rotary steerable drilling system of the present invention also utilizes a braking system (electrical, hydraulic or mechanical) to control the rotation of the bit shaft when the torque of the bit/formation interaction is prevalent as compared to internal friction. Within the scope of the present invention the sensors and electronics of the tool may be rotated along with the drilling tool collar or may be maintained geostationary along with the axis of the bit shaft of the rotary steerable drilling system.

SUMMARY OF THE INVENTION

It is a principal feature of the present invention to provide a novel drilling system that is driven by a rotary drill string and permits selective drilling of curved wellbore sections by precision steering of the drill bit being rotated by the drill string and drilling tool;

It is also a feature of the present invention to provide a novel actively controlled rotary steerable well drilling system having a bit shaft that is rotatably driven by the collar during drilling and which is mounted intermediate its length for omnidirectional pivotal movement within the collar for the purpose of geostationary positioning of the bit shaft and drill bit relative to the tool collar to thereby continuously point the drill bit supported thereby at a desired angle for the drilling of a curved wellbore;

It is another feature of the present invention to provide a novel actively controlled rotary steerable well drilling system having an offsetting mandrel which is rotated counter to the direction of rotary movement of the tool collar and at the same frequency of rotation, thus imparting rotary motion to the bit shaft about its omnidirectional pivotal mount to maintain the bit shaft geostationary;

It is another feature of the present invention to provide a novel actively controlled rotary steerable well drilling system having within the tool a drilling fluid powered turbine that is connected in driving relation with an alternator for generation of sufficient electrical power to drive a motor that counteracts the resistive torque between the collar or housing of the drilling tool and the offsetting mandrel that counter-rotates within the tool collar and accomplishes geostationary positioning of the movable bit shaft for the purpose of drill bit steering;

It is another feature of the present invention to provide a novel actively controlled rotary steerable well drilling system having on-board electronic power and control system circuitry that is mounted throughout the length of the tool and is rotatable along with the drill string driven tool collar;

It is an even further feature of the present invention to provide a novel actively controlled rotary steerable well drilling system having sensors and electronics that are rotatable along with the drill collar thereof or geostationary in line with the offsetting mandrel thereof;

It is also a feature of the present invention to provide a novel actively controlled rotary steerable well drilling system having therein an electrically, hydraulically, or mechanically controlled braking system for maintaining the offsetting mandrel and bit shaft axis geostationary during drilling;

It is an even further feature of the present invention to provide an embodiment of the actively controlled rotary steerable well drilling system having a brake that controls the drilling fluid powered turbine and which is controlled based on the real-time measurement of the toolface; and It is another feature of an embodiment of the present invention to provide a novel actively controlled rotary steerable well drilling system having a transmission mechanism interconnecting the brake and the drilling fluid powered turbine and providing for appropriate dissipation of energy by the brake while allowing the drilling fluid powered turbine to operate at an efficient rotary speed for optimum generation of power.

Briefly, the various objects and features of the present invention are realized through the provision of an actively controlled rotary steerable drilling tool having a collar or housing that is connected directly to a rotary drill string that is driven by the rotary table of a drilling rig. Though the description herein is directed particularly to an electronically energized and actively controlled rotary steerable drilling tool, it is not intended to so restrict the present invention. This invention is equally applicable to hydraulically controlled rotary steerable drilling tools and rotary steerable drilling tools incorporating both electronic and hydraulic control features. A bit shaft having a drill bit connected thereto is mounted within the collar by means of an omni-directional mount and is rotatable directly by the tool collar for the purpose of drilling. A lower section of the bit shaft projects from the lower end of the collar and provides support for the drill bit. According to the concept of this invention, the bit shaft axis is counter-rotated with respect to the tool collar about its pivotal mount and is thus maintained pointed in a given direction, which is inclined by a variable angle with respect to the axis of the tool, thus allowing the drill bit to drill a wellbore on a curve that is determined by the selected angle. A straight bore can be drilled either by setting the angle between the bit shaft axis and the tool axis to zero or by rotating the bit shaft axis around the tool axis at a different frequency. The angle between the axis of the bit shaft and the axis of the collar of the drilling tool is obtained by means of an offsetting mandrel which counter-rotates with respect to the collar and which maintains the bit shaft axis geostationary. The rotary steerable drilling tool of the present invention incorporates a mechanism that is operated downhole for controllably changing this angle as desired for the purpose of controllably steering the drill bit being rotated by the tool. Torque is transmitted from the tool collar to the bit shaft directly through the universal joint. As the collar is rotated by the drill string, the resistive torque $T_{res}$ acting between the collar and the offsetting mandrel and its supports, which is mainly due to friction, tends to rotate the offsetting mandrel together with the collar so that an over-gauge hole would be drilled. To prevent this or, more specifically, to keep the bit shaft geostationary despite the rotation of the collar, an electric motor powered by a mud powered turbine and alternator is employed which generates enough power to counteract the resistive torque. An electric, hydraulic or mechanical brake is employed to counteract the effect of the interaction between the formation and the bit, which interaction could result in a torque opposite to the internal resistive torque of the rotary steerable drilling system. In addition, the motor and the brake are servo-controlled to guarantee that the toolface is maintained in the presence of external disturbances. Since it should always remain geostationary, the offsetting mandrel should always be pivotally rotated at a speed equal and opposite the rotational speed of the collar, with respect to the collar. In another embodiment of this invention a drilling fluid powered turbine is connected in driving relation with the electromagnetic brake. To allow the turbine to rotate at higher speeds more suited to the operation of an axial turbine, a transmission mechanism having a gear train is used between the turbine and the offsetting mandrel so that the offsetting mandrel is rotated at a slower speed and with enhanced power for achieving geostationary positioning of the bit shaft.

To enhance the flexibility of the actively controlled rotary steerable drilling tool, the tool has the capability of selectively incorporating many electronic sensing, measuring, feedback and positioning systems. A three-dimensional positioning system of the tool can employ magnetic sensors for sensing the earth's magnetic field and can employ accelerometers and gyroscopic sensors for accurately determining the position of the tool at any point in time. For control the rotary steerable drilling tool will typically be provided with three accelerometers and three magnetometers. A single gyroscopic sensor will typically be incorporated within the tool to provide rotational speed feedback and to assist in stabilization of the mandrel, although a plurality of gyroscopic sensors may be employed as well without departing from the spirit and scope of this invention. The signal processing system of the electronics on-board the tool achieves real time position measurement while the tool is rotating and while it is rotating the bit shaft and drill bit during drilling operations. The sensors and electronics processing system of the tool also provides for continuous measurement of the azimuth and the actual angle of inclination as drilling progresses so that immediate corrective measures can be taken in real time, without necessitating interruption of the drilling process. The tool incorporates a position based control loop using magnetic sensors, accelerometers and gyroscopic sensors to provide position signals for controlling the motor and the brake of the tool. With regard to braking, it should be borne in mind that the electric motor for driving the offsetting mandrel also is controllable by the internal control system of the tool to provide a braking function as needed to counteract the effect of the interaction between the formation and the drill bit resulting in torque that is opposite to the internal resistive torque of the tool. Also from the standpoint of operational flexibility, the tool may incorporate a measuring while drilling (MWD) system for feedback, positive displacement motor/turbine, gamma ray detectors, resistivity logging, density and porosity logging, sonic logging, borehole imaging, look ahead and look around instrumentation, inclination at the bit measurement, bit rotational speed measurement, vibration below the motor sensors, weight on bit, torque on bit, bit side force, a soft weight system with a thruster controlled by the tool to maximize drilling efficiency, a variable gauge stabilizer controlled by the tool, or a mud motor dump valve controlled from the tool to control drilling speed and torque. The tool may also incorporate other measurement devices that are useful for well drilling and completion.

The design of the tool adds downhole soft-torque intrinsically to minimize bit wear and to achieve maximum drilling efficiency. Software is employed in the operational control system electronics on-board the tool to minimize stick-slip. Additionally, the tool provides the possibility of programming the tool from the surface so as to establish or change the tool azimuth and inclination and to establish or change the bend angle relation of the bit shaft to the tool collar. The electronic memory of the on-board electronics of the tool is capable of retaining, utilizing and transmitting a complete wellbore profile and accomplishing geosteering capability downhole so it can be employed from kick-off to extended reach drilling. Additionally, a flexible sub may be employed with the tool to decouple the rotary steerable drilling tool from the rest of the bottom-hole assembly and drill string and allow navigation from the rotary steerable drilling system.

In addition to other sensing and measuring features of this invention, the actively controlled rotary steerable drilling tool may also be provided with an induction telemetry coil or coils to transmit logging and drilling information that is obtained during drilling operations to the MWD system bidirectionally through the flexible sub, the motor, the thruster and other measurement subs. For induction telemetry the rotary steerable drilling tool typically incorporates an inductor within the tool collar. The tool also incorporates transmitters and receivers located in predetermined axially spaced relation to thus cause signals to traverse a predetermined distance through the subsurface formation adjacent the wellbore and thus measure its resistivity. Such a system is described in U.S. Pat. No. 5,594,343, which is incorporated herein by reference.

The electronics of the resistivity system of the tool, as well as the electronics of the various measurement and control systems, are capable of rotation along with rotary components of the tool and will thus withstand the effects of drill string rotation as well. In the alternative, certain components of the electronics system of the rotary steerable drilling tool may be geostationary.

In the preferred embodiment of the present invention a drilling fluid driven turbine is interconnected in driving relation with an alternator to develop electrical energy from the power of the flowing drilling fluid. For optimum turbine and alternator operation a mechanical transmission may be interposed between the turbine and the alternator. An electric motor, which is not mechanically interconnected with the turbine or alternator, has its electrical supply input connected to the electrical output of the alternator, with an electrical control system being in assembly with the motor for its operational control. In addition, a brake which is not mechanically interconnected with the turbine or alternator is available to maintain the bit shaft axis geostationary when the formation friction effect prevails. The rotary output of the motor is used to drive the geostationary mandrel of the rotary steerable drilling tool, thus turbine and alternator operation cannot interfere directly with operation of the motor and bit shaft orientation control. For the purpose of mechanical efficiency, according to the preferred embodiment, the bit shaft positioning system employs a universal bit shaft support employing balls and rings establishing a hook-like joint which provides the bit shaft with both efficient support in the axial direction and torque and at the same time minimizes friction at the universal joint. Friction of the universal joint is also minimized by ensuring the presence of lubricating oil about the components thereof and by excluding drilling fluid from the universal joint while permitting significant cyclical steering control movement of the bit shaft relative to the tool collar as drilling is in progress. Alternatively, instead of the ball and ring type universal joint, the universal joint may take the form of a spline type joint or a universal joint incorporating splines and rings.

The electric motor of the rotary steerable drilling system is powered by electric current that is generated by drilling fluid flow through a turbine. To control the electrical power output the turbine can have variable efficiency, which is achieved by moving the stator relative to the rotor. The turbine may also have multiple stages or it may be provided with braking such as by a resistor load.

BRIEF DESCRIPTION OF THE DRAWINGS

So that the manner in which the above recited features, advantages and objects of the present invention are attained can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a schematic illustration showing a well being drilled in accordance with the present invention and showing deviation of the lower portion of the wellbore by the actively controlled rotary steerable drilling system and method hereof;

FIG. 2 is a schematic illustration showing a well being drilled by the actively controlled rotary steerable drilling system and method hereof and employing in the rotary drill string a mud motor located above the actively controlled rotary steerable drilling system and rotating the tool collar of the steerable drilling system at a speed that is different from the rotary speed of the drill string;

FIG. 3 is a schematic illustration similar to that of FIG. 2 and showing the mud motor located below the actively controlled rotary steerable drilling system and providing for direct rotation of the drill bit at a speed different from the drill string;

FIG. 4 is a schematic illustration showing a thruster being located in the drill string immediately above the actively controlled rotary steerable drilling system for controlling weight on bit while rotary drilling speed and torque are being controlled by the rotary steerable drilling system;

FIG. 5 is a schematic illustration showing a thruster being located in a drill string immediately below the actively controlled rotary steerable drilling system;

FIG. 6 is a schematic illustration showing a thruster being located in a drill string immediately below a mud motor and connected above the actively controlled rotary steerable drilling system and providing for rotation of the rotary steerable drilling system at a rotational speed that differs from that of the drill string;

FIG. 7 is a schematic illustration showing a thruster located in a drill string immediately above a mud motor and with the mud motor located above the actively controlled rotary steerable drilling system;

FIG. 8 is a schematic illustration showing the actively controlled rotary steerable drilling system located in a drill string and showing a mud motor connected below the rotary steerable drilling system and a thruster connected below the mud motor so that the mud motor provides support for the drill bit;

FIG. 9 is a schematic illustration showing the actively controlled rotary steerable drilling system located in a drill string and showing a thruster connected below the rotary steerable drilling system and further showing a mud motor connected below the thruster and supporting the drill bit;

FIG. 10 is a schematic illustration of the rotary steerable drilling system of the present invention showing the straight condition of a flexible sub;

FIG. 11 is a schematic illustration of the rotary steerable system of FIG. 10 showing the bending of the flexible sub;

Figure 12:
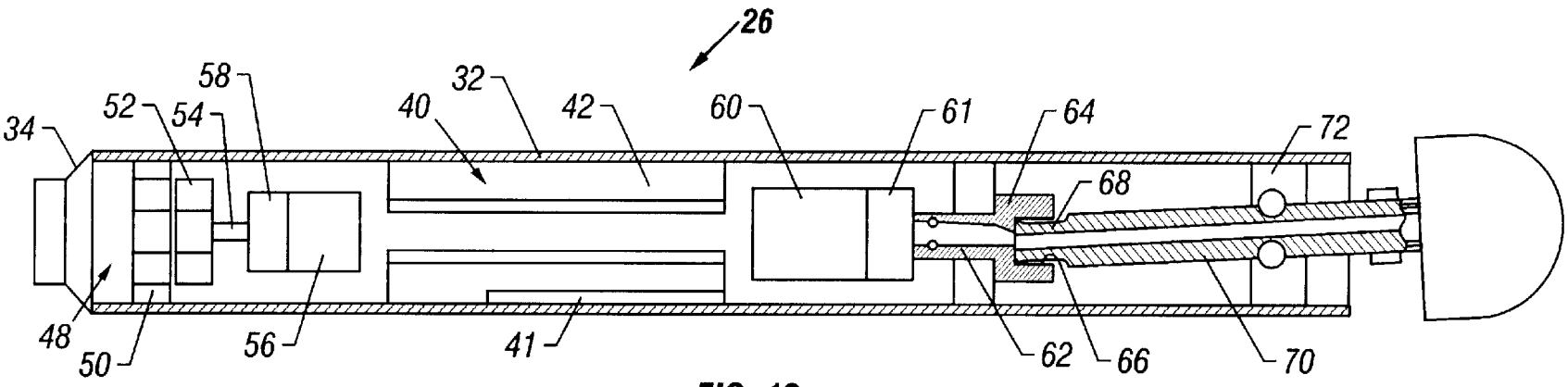
Figure 13:
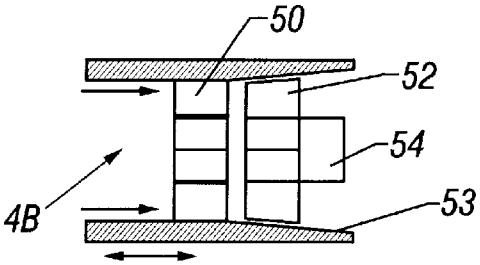
Figure 14:
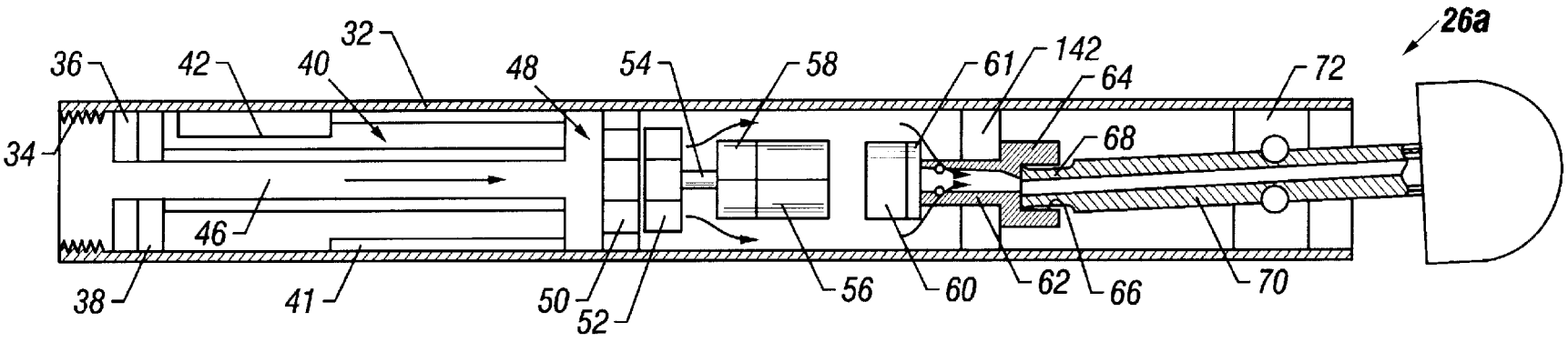
Figure 15:
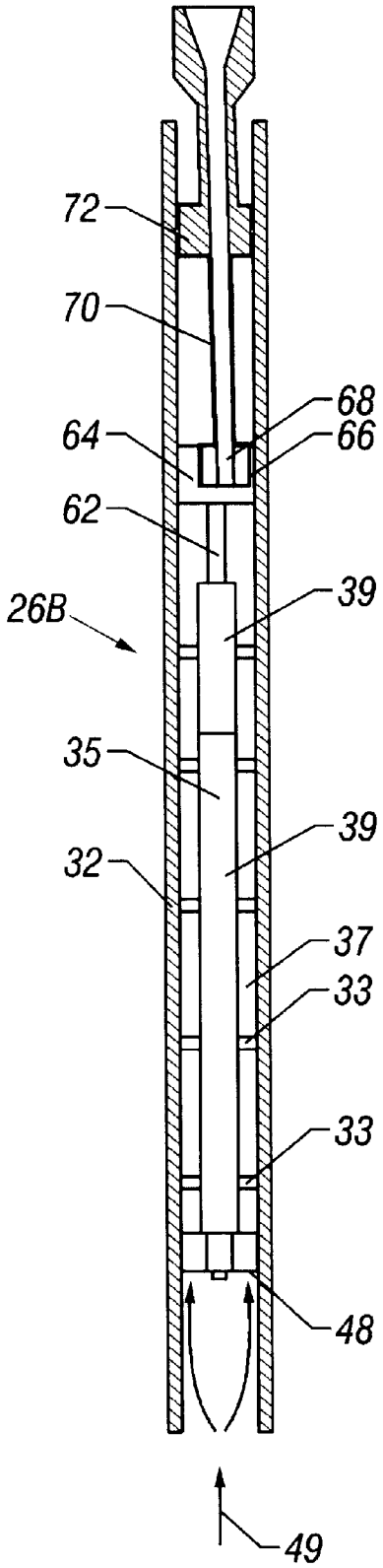
Figure 16:
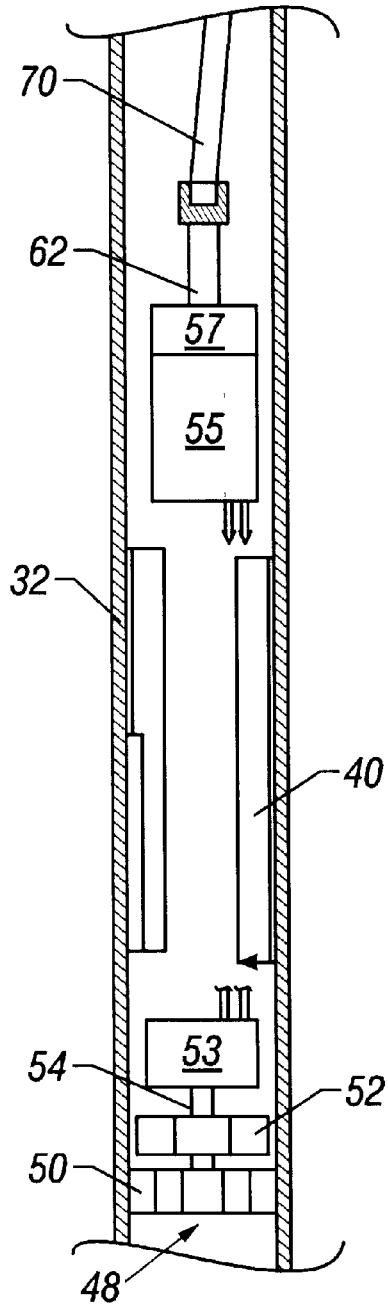
Figure 17:
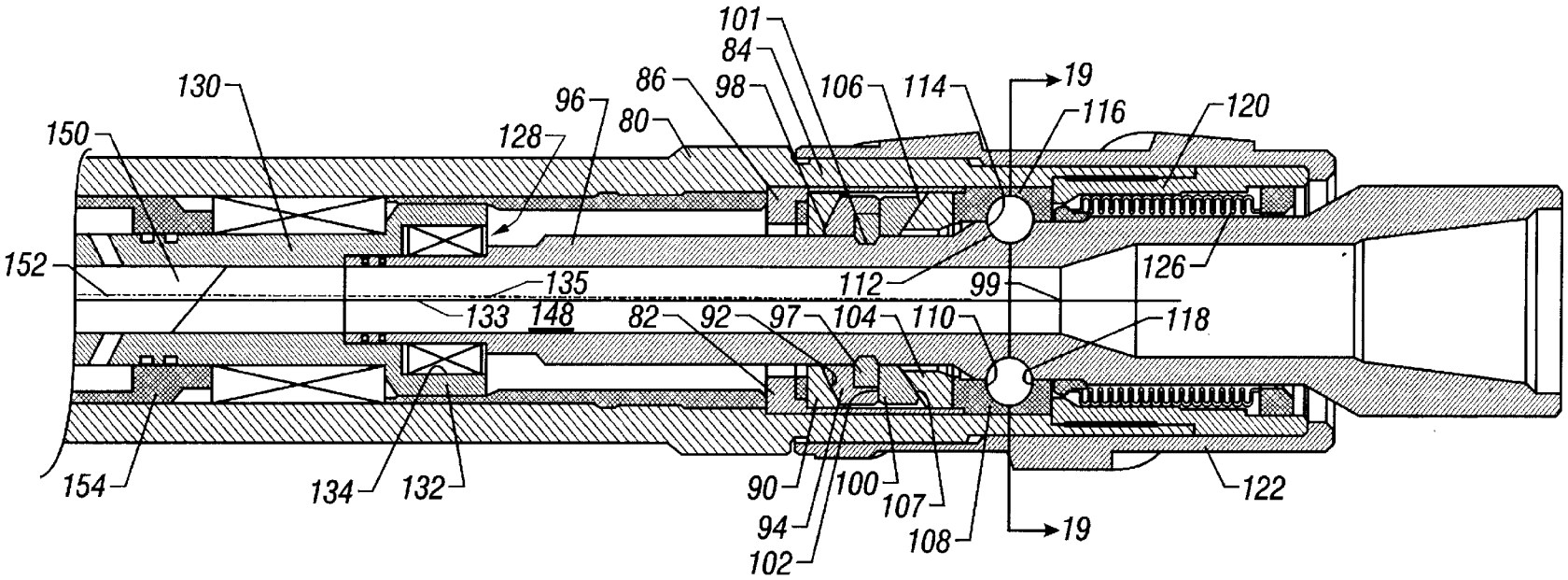
Figure 18:
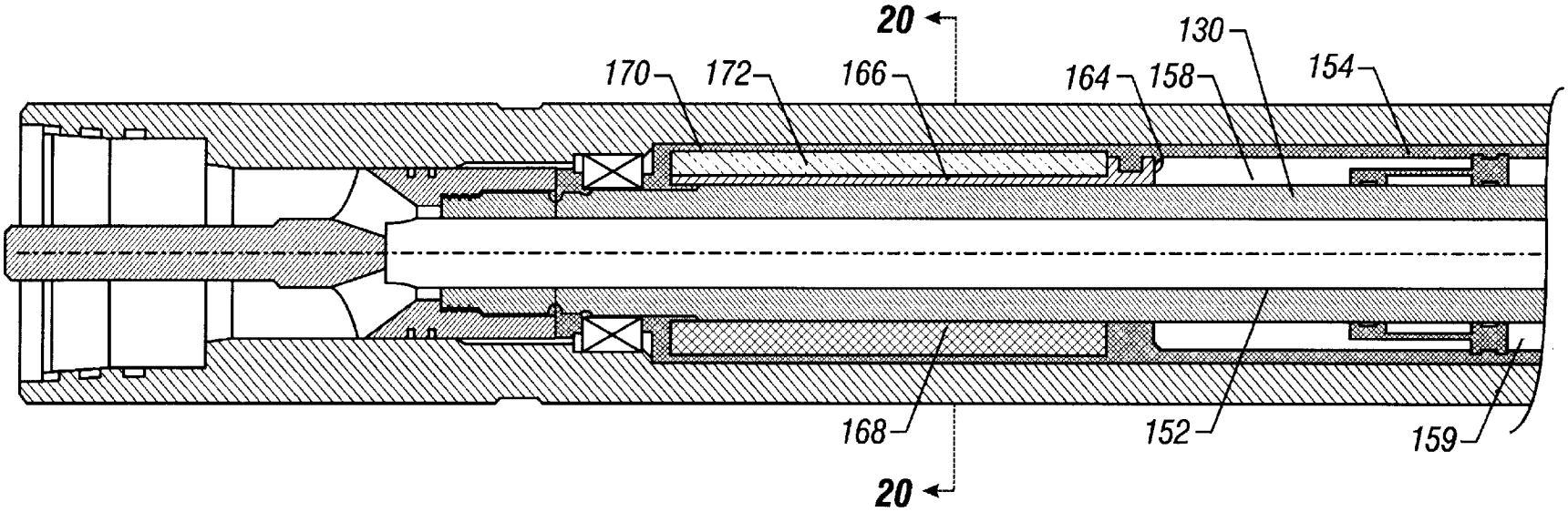
Figure 19:
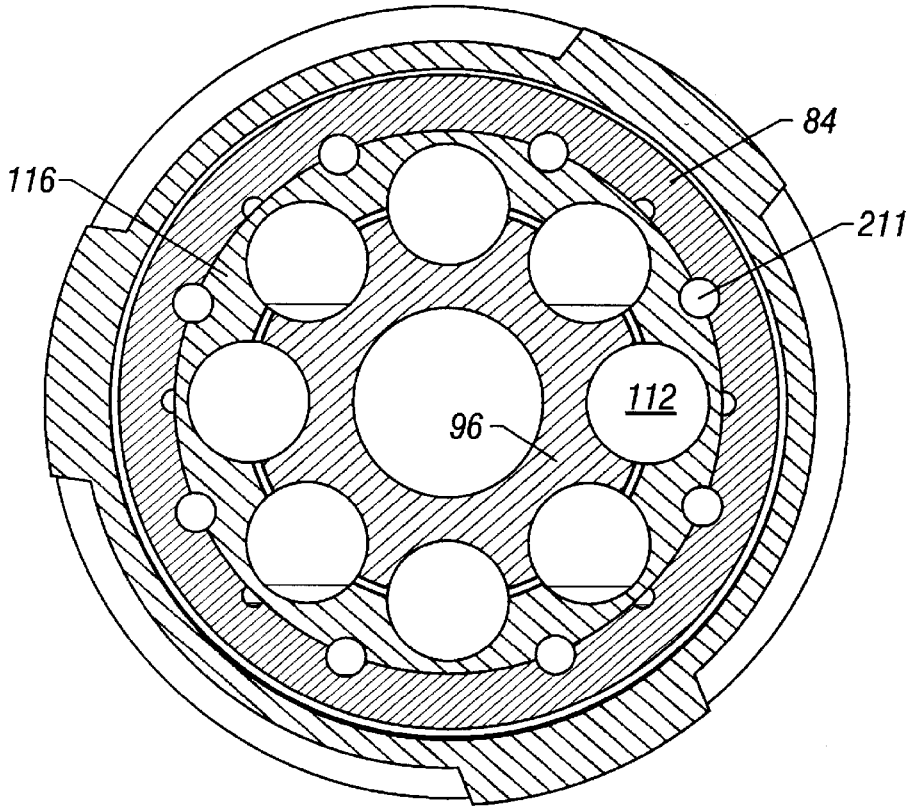
Figure 20:
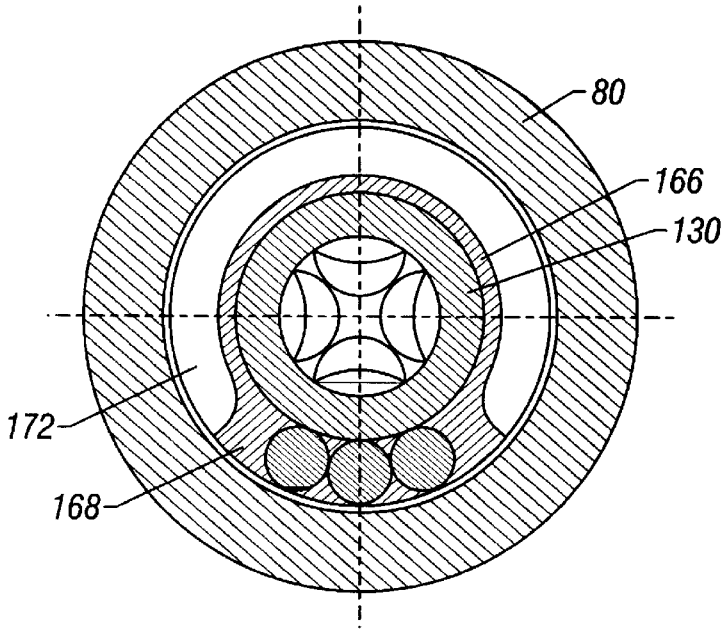
Figure 21:
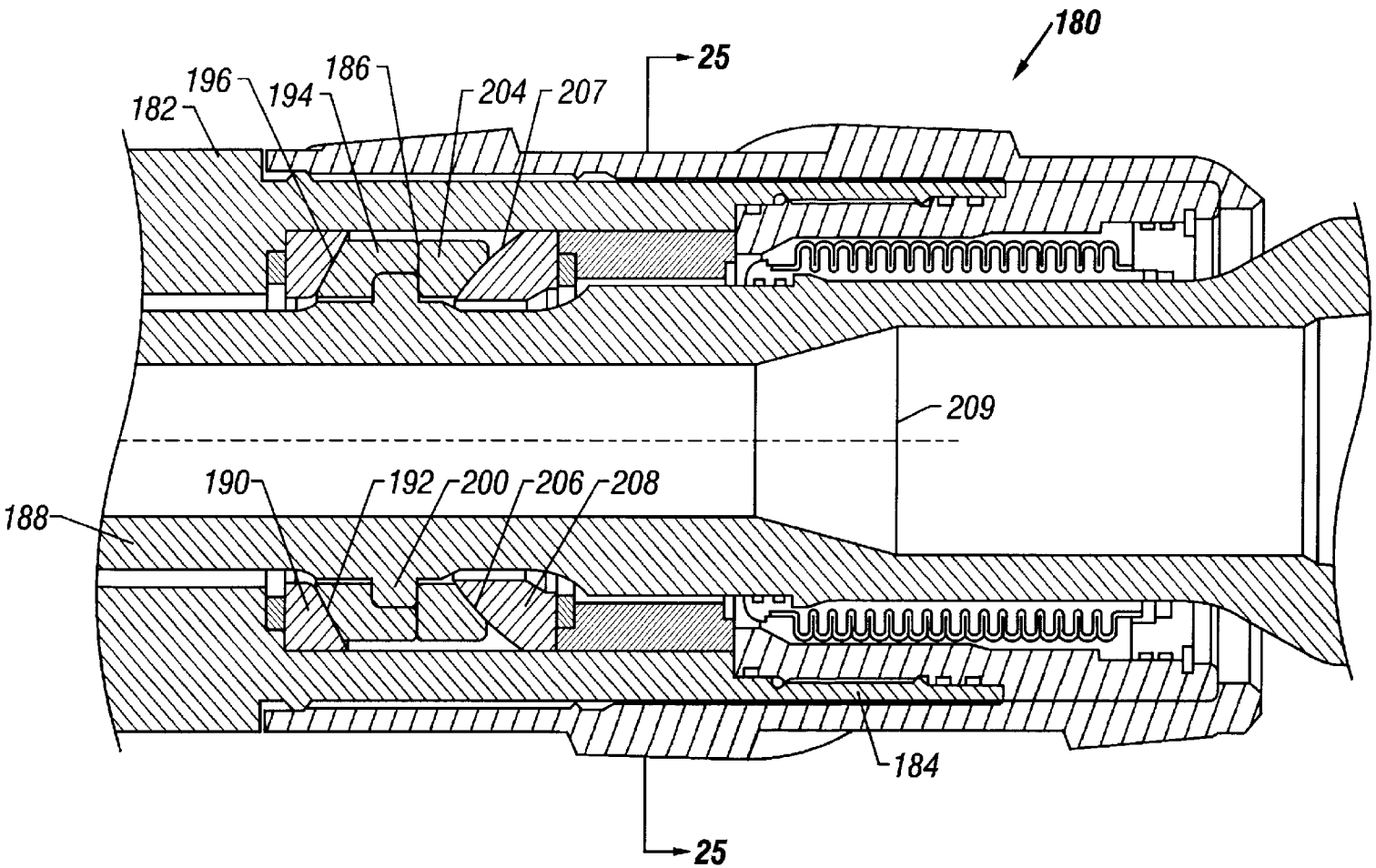
Figure 22A:
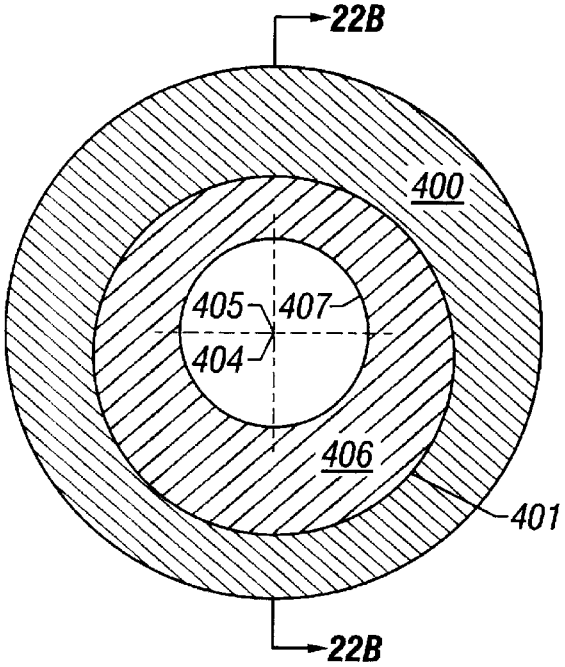
Figure 22B:
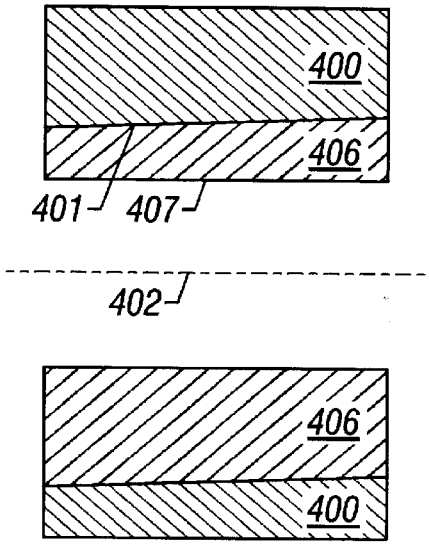
Figure 22C:
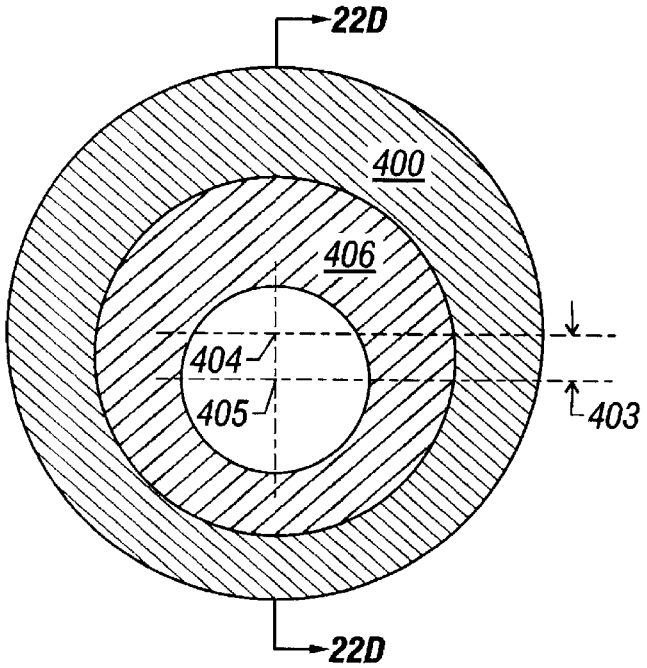
Figure 22D:
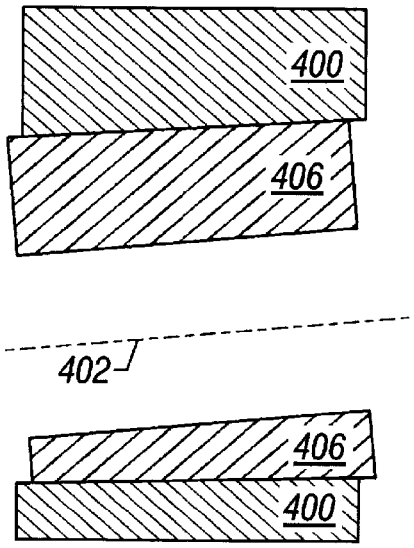
Figure 23:
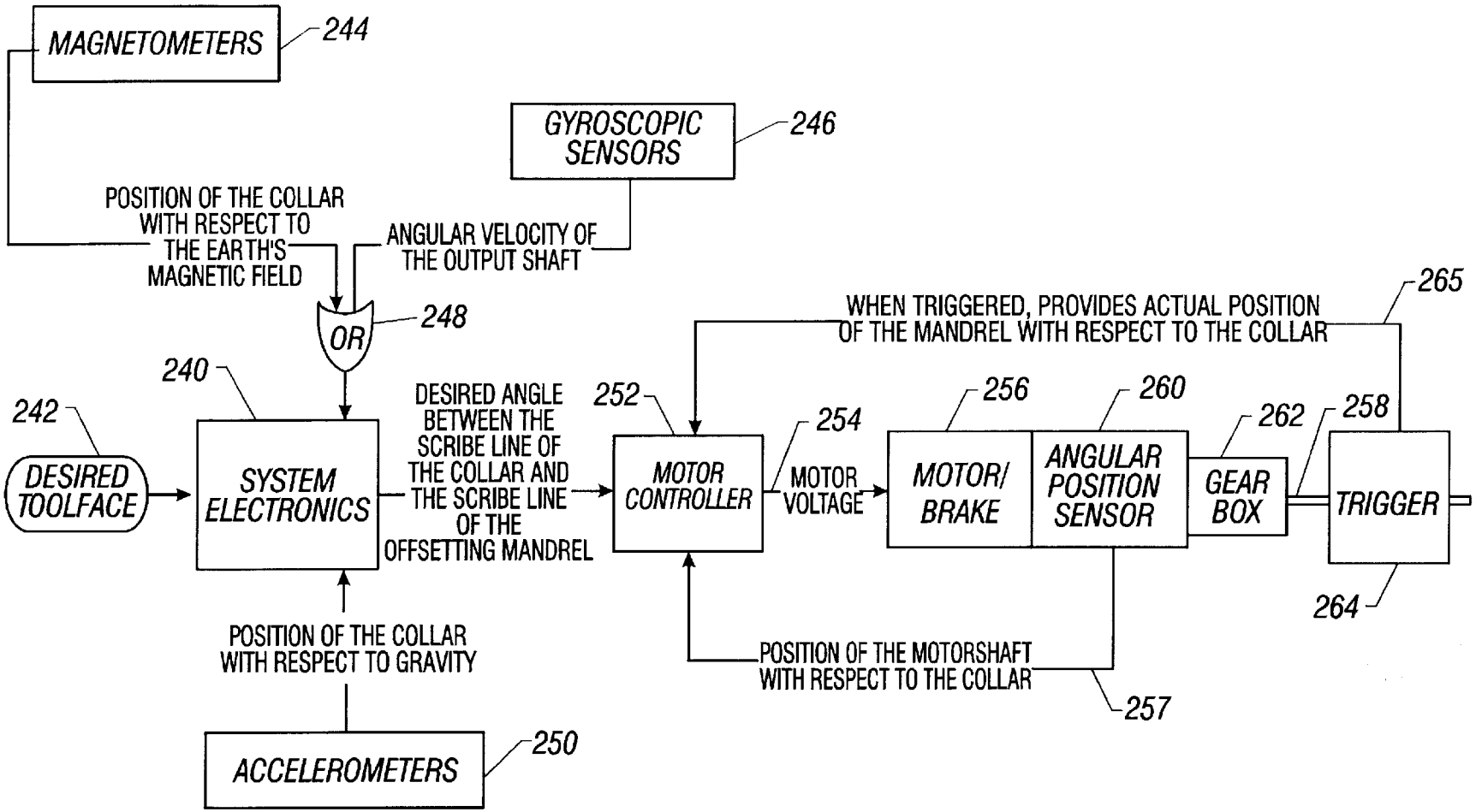
Figure 24:
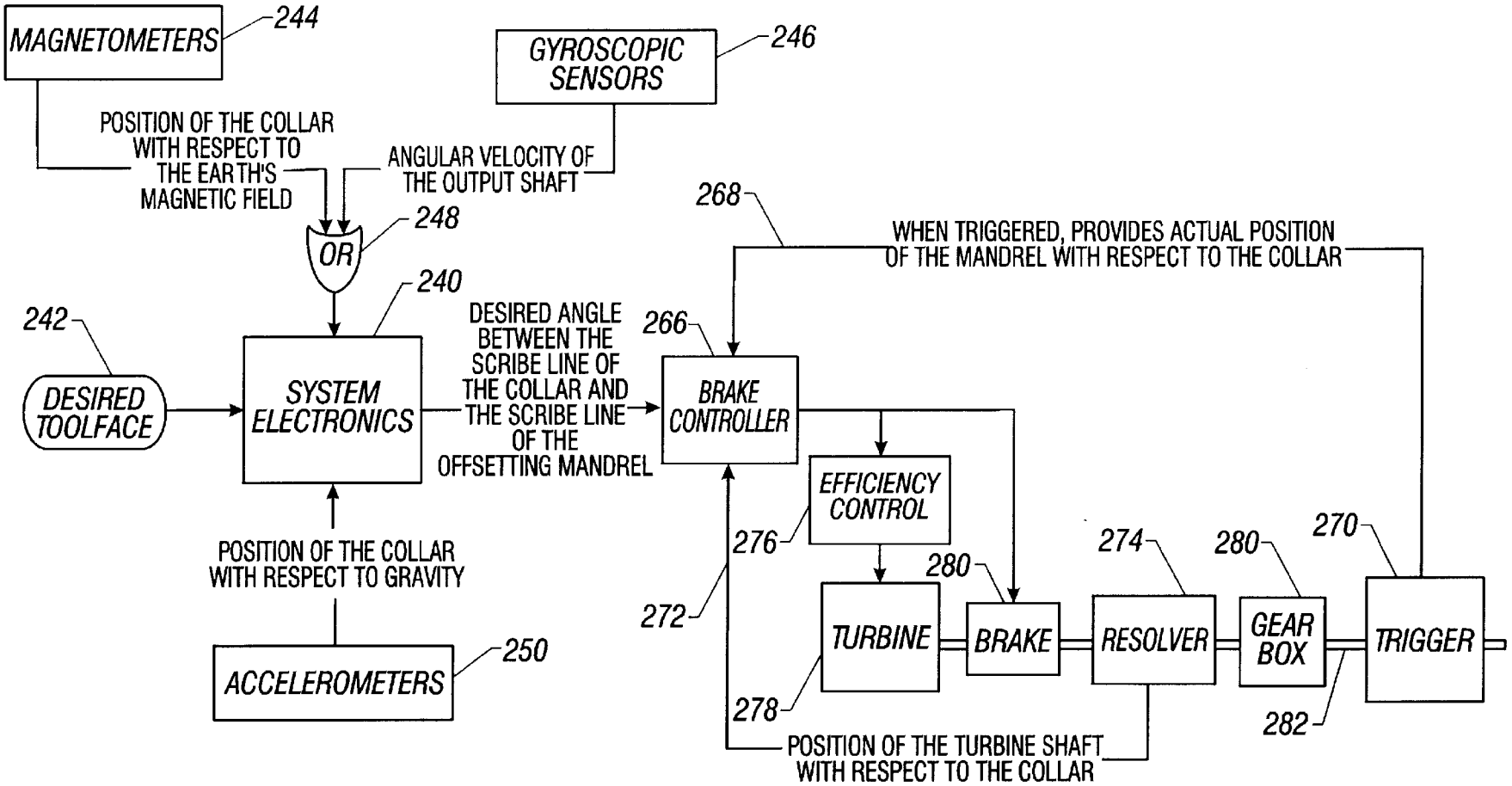
Figure 25:
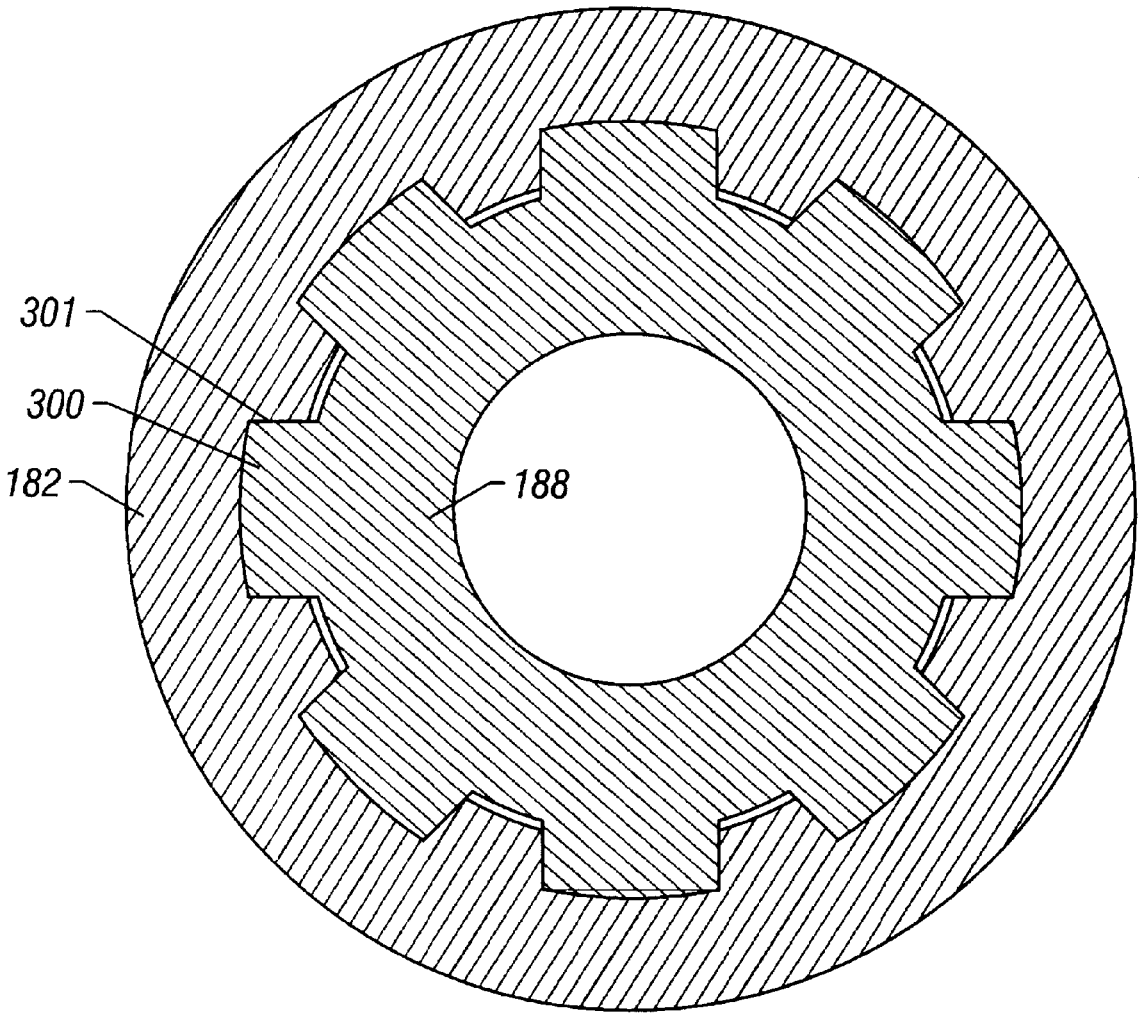

FIG. 12 is a schematic illustration in longitudinal section showing an actively controlled rotary steerable drilling system representing the preferred embodiment of the present invention and having a turbine driven alternator, with the electric current output thereof being utilized to drive an electric motor having a motor output shaft connected in driving relation with an omnidirectional bit shaft support and positioning mechanism for maintaining the longitudinal axis of the bit shaft geostationary and at a predetermined angle relative to the axis of rotation of the tool collar;

FIG. 13 is a schematic illustration in section showing a turbine which may be utilized for the turbines of FIGS. 12 and 14, and illustrating turbine stator positioning relative to the rotor for controlling the efficiency and power output of the turbine;

FIG. 14 is a schematic longitudinal sectional view of an actively controlled rotary steerable drilling system representing an alternative embodiment of the present invention and showing a turbine connected in driving relation with an alternator and with the turbine and alternator being located in the same section of the tool collar as the motor, offsetting mandrel and bit shaft and further showing a mechanism providing omnidirectional pivotal support within the tool collar for the bit shaft;

FIG. 15 is a schematic longitudinal sectional view of an actively controlled rotary steerable drilling system representing an alternative embodiment of the present invention and showing a turbine connected in driving relation with a gear box via a turbine drive shaft extending through the electronics, sensors and brake section of the drilling system and with the output of the gear box connected in driving relation with an offsetting mandrel for accomplishing geostationary positioning of the axis of a bit shaft;

FIG. 16 is a partial longitudinal sectional view illustrating a further alternative embodiment of the present invention showing a rotary steerable drilling tool having a hydraulically powered system for orienting the bit shaft of the tool during drilling operations;

FIG. 17 is a longitudinal sectional view showing the lower portion of the actively controlled rotary steerable drilling system of FIG. 12 in greater detail;

FIG. 18 is a longitudinal sectional view showing the upper portion of the actively controlled rotary steerable drilling system of FIG. 12 in greater detail;

FIG. 19 is a transverse sectional view taken along line 19—19 of FIG. 17;

FIG. 20 is a transverse sectional view taken along line 20—20 of FIG. 18;

FIG. 21 is a partial transverse sectional view of an alternative embodiment of the present invention showing a spline type universal joint for omnidirectional support of the bit shaft within the tool collar and for imparting driving rotation to the bit shaft for rotation of the drill bit;

FIG. 22A is a schematic illustration in transverse section showing the bit shaft positioning rings relatively positioned for straight drilling and showing coincidence of the longitudinal axes of the bit shaft and tool collar for zero angulation of the bit shaft;

FIG. 22B is a sectional view taken along line 22B—22B of FIG. 22A and showing the coaxial relationships of the bit shaft positioning rings for straight drilling;

FIG. 22C is a schematic illustration in transverse section showing the bit shaft positioning rings located at positions for maximum offset and thus maximum lateral positioning of the centerline of the bit shaft for maximum angulation of the bit shaft relative to the tool collar;

FIG. 22D is a sectional view taken along line 22D—22D of FIG. 22C showing the offset axial relationships of the bit shaft positioning rings for maximum offset and thus drilling at maximum rate of curvature;

FIG. 23 is a block diagram schematic illustration showing the control architecture of the preferred embodiment of the rotary steerable drilling system of the present invention, showing the concept of turbine powered braking and brake control for the purpose of steering the drill bit that is oriented by the tool;

FIG. 24 is a block diagram schematic illustration showing the control architecture of an alternative embodiment of the present invention having a drilling fluid powered turbine and brake for controlling bit shaft positioning relative to the tool collar and a position signal responsive brake controller for controlling the brake and for controlling turbine efficiency; and FIG. 25 is a transverse sectional view taken along line 25—25 of FIG. 21 showing a splined drive connection between the bit shaft and drilling tool collar.

DESCRIPTION OF THE PREFERRED EMBODIMENTS

Figure 1:
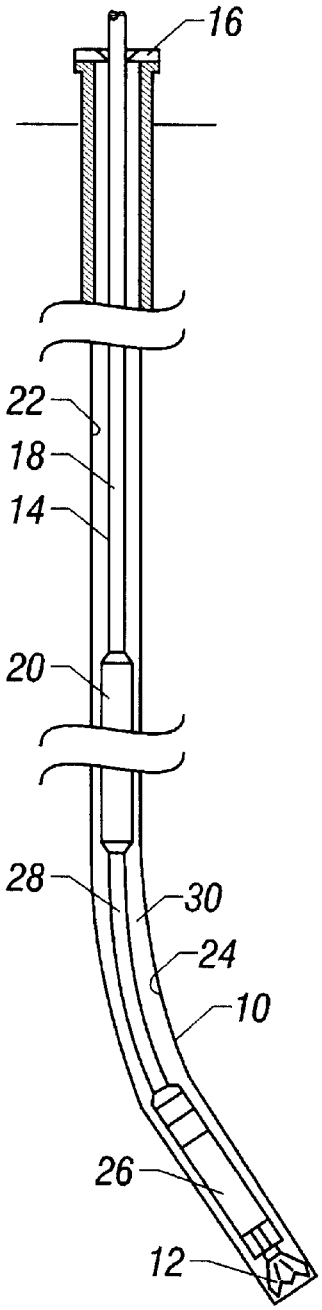

Referring now to the drawings and first to FIG. 1, a wellbore 10 is shown being drilled by a rotary drill bit 12 that is connected at the lower end of a drill string 14 that extends upwardly to the surface where it is driven by the rotary table 16 of a typical drilling rig (not shown). The drill string 14 typically incorporates a drill pipe 18 having one or more drill collars 20 connected therein for the purpose of applying weight to the drill bit 12. The wellbore 10 is shown as having a vertical or substantially vertical upper section 22 and a deviated, curved or horizontal lower section 24 which is being drilled under the control of an actively controlled rotary steerable drilling tool shown generally at 26 which is constructed in accordance with the present invention. To provide the flexibility that is needed in the curved section 24 of the wellbore 10 a lower section of drill pipe 28 may be used to connect the drill collars 20 to the drilling tool 26 so that the drill collars will remain in the vertical section 22 of the wellbore 10. The lower section 24 of the wellbore 10 will have been deviated from the vertical section 22 by the steering activity of the drilling tool 26 in accordance with the principles set forth herein. As shown at 28 in FIG. 1, the drill string immediately adjacent the rotary steerable drilling tool, may incorporate a flexible sub, also shown in FIGS. 10 and 11, which can provide the rotary steerable drilling system with enhanced accuracy of drilling. In accordance with the usual practice, drilling fluid or "mud" is circulated by surface pumps down through the drill string 14 where it exits through jets that are defined in the drill bit 12 and returns to the surface through an annulus 30 between the drill string 14 and the wall of the wellbore 10. As will be described in detail below, the rotary steerable drilling tool 26 is constructed and arranged to cause the drill bit 12 to drill along a curved path that is designated by the control settings of the drilling tool 26. The angle of the bit shaft supporting the drill bit 12 with respect to the tubular collar of the drilling tool 26 is maintained even though the drill bit and drilling tool are being rotated by the drill string 14, thereby causing the drill bit to be steered for drilling a deviated wellbore. Steering of the drilling tool is selectively accomplished from the standpoint of inclination and from the standpoint of azimuth, i.e., left and right. Additionally, the settings of the steerable drilling tool 26 may be changed as desired to cause the drill bit to selectively alter the course of the wellbore being drilled to thereby direct the deviated wellbore for precision steering of the drill bit and thus precision control of the wellbore being drilled.

Figure 2:
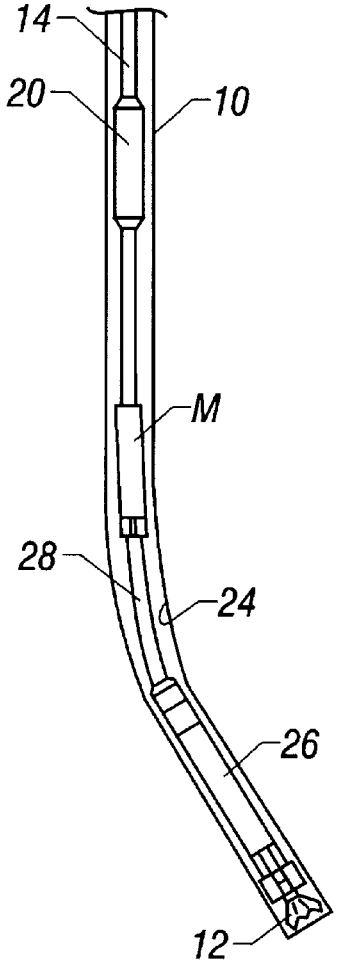
Figure 3:
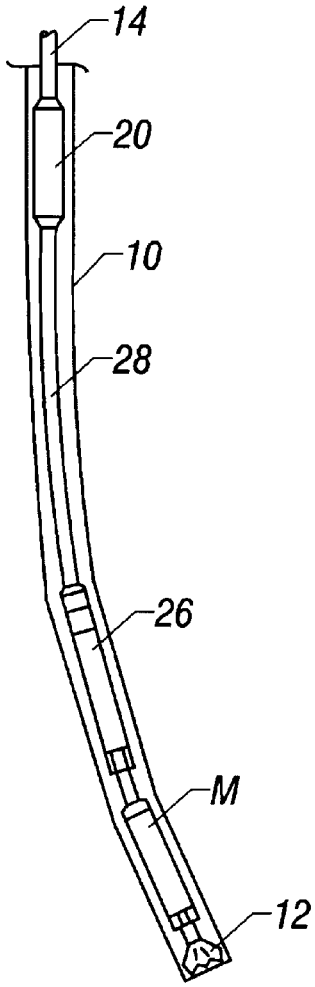

FIGS. 2 and 3 are schematic illustrations showing the rotary steerable drilling system of the present invention located within a wellbore 10 being drilled and further showing a method of drilling wherein a mud motor M is utilized within the rotary drill string either above the steerable drilling tool as shown in FIG. 2 or below the steerable drilling tool as shown in FIG. 3. This unique arrangement permits rotation of the drill string 14 at a desired rotational speed and rotation of the mud motor output at a different rotational speed to provide for optimum drilling characteristics without causing excessive fatigue of the drill string. When the rotary steerable drilling system of the present invention is connected directly to the drill string, the rotational speed of the drill bit is the same as that of the drill string. This limits the maximum rotational speed of the drill bit because enhanced rotational speed of the drill string could limit drill string service life due to fatigue. When the mud motor M of FIGS. 2 and 3 is run in combination with the rotary steerable drilling system, the rotary table of the drilling rig can be set at an optimum rotational speed for the drill string and the mud motor will be capable of adding rotational speed to the drill bit that is driven by the mud motor output. The rotary table can be operated at a rotational speed of 50 revolutions per minute for example, to allow breaking of the friction between the borehole and the drill string, a rotational speed that will not limit the service life of the drill string due to fatigue, while the rotational speed of the drill bit can be increased by the mud motor to provide for enhanced drilling characteristics to thus enable extended reach drilling. The rotary steerable drilling system can be operated at the mud motor controlled rotational speed when located below the mud motor and can be rotated at drill string speed if connected directly to the drill string. If the mud motor is located below the rotary steerable drilling tool, its rotary output is imparted directly to the drill bit. Steering characteristics during drilling will have greater precision when the mud motor is located above the rotary steerable drilling tool for the reason that the distance from the rotary steerable drilling tool to the drill bit is a principal controlling factor from the standpoint of steering precision.

Figure 4:
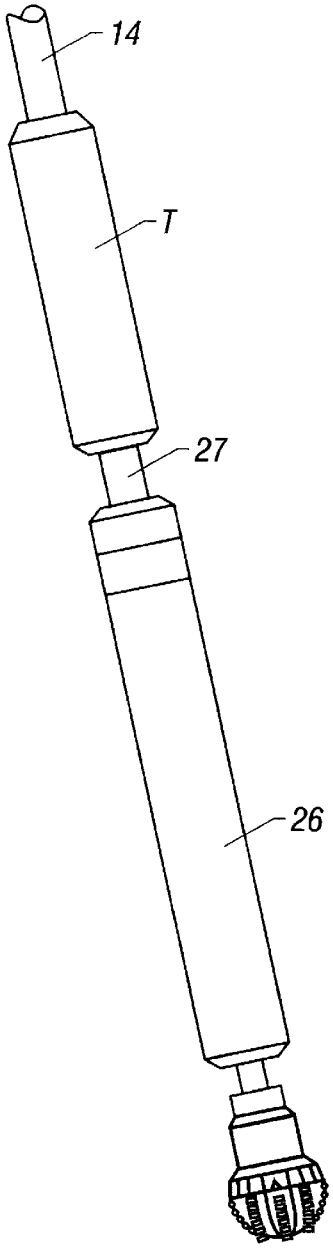
Figure 5:
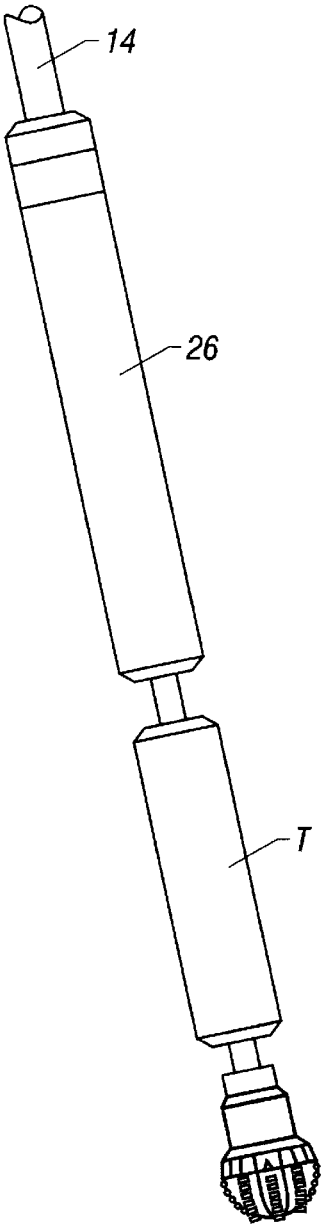
Figure 6:
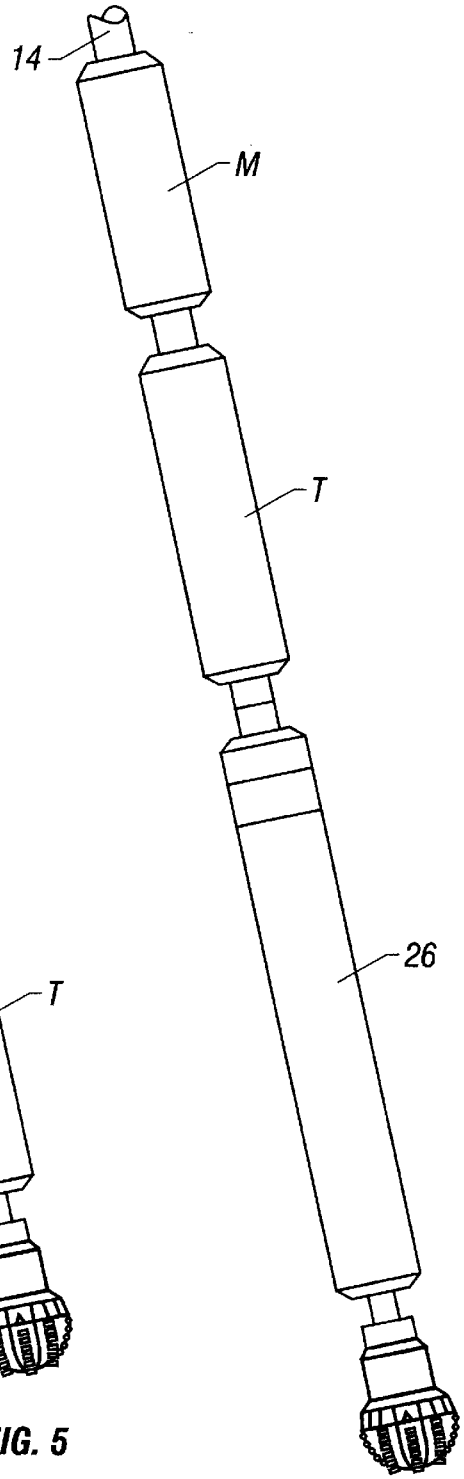
Figure 7:
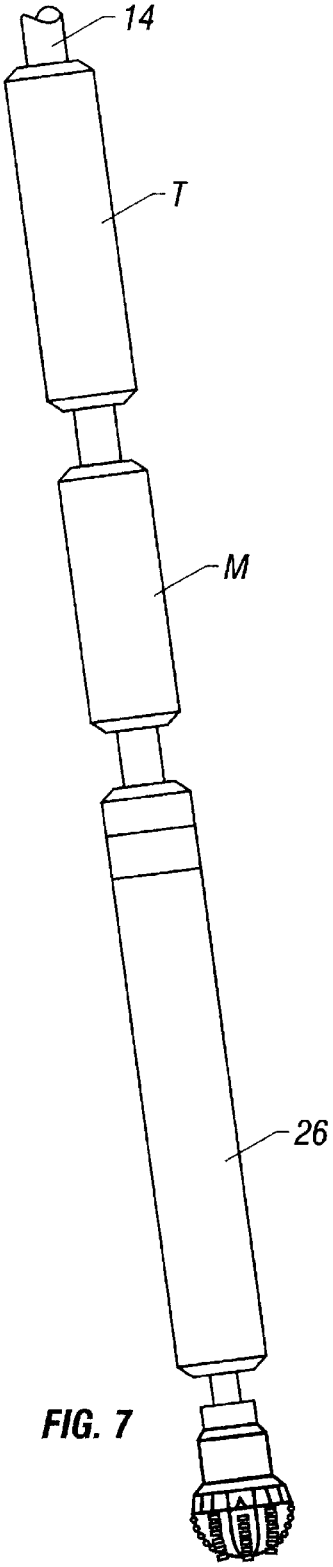
Figure 8:
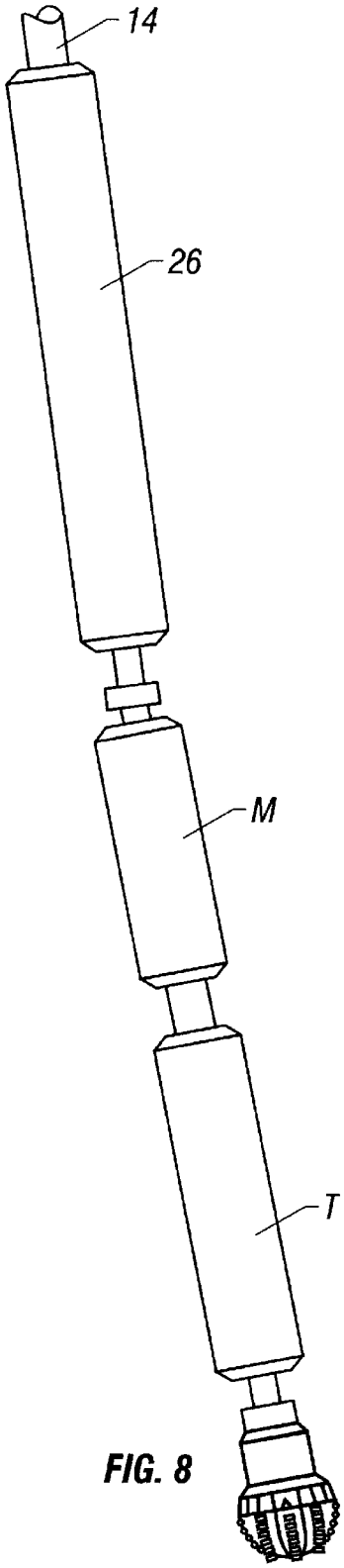
Figure 9:
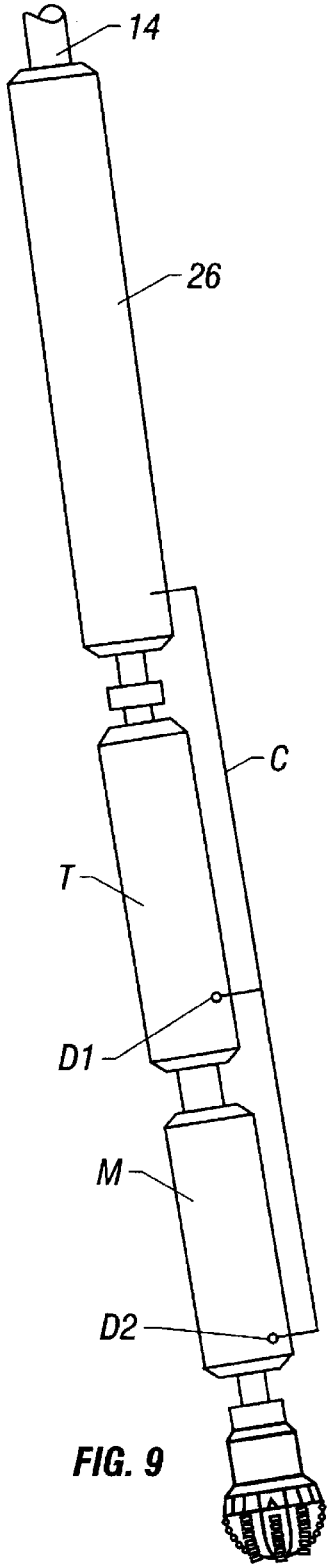

It should be borne in mind that the rotary steerable drilling system of the present invention may be connected in a drill string in association with other drilling tools such as mud motors, as described above, for controlling rotational speed and torque, and thrusters for controlling weight on bit. Moreover, the arrangement of these components within a drill string may be selected by drilling personnel according to a wide variety of characteristics, such as the tightness of the curved wellbore section being drilled, the characteristics of the formation being drilled, the character of drilling equipment being employed for drilling, and the depth at which drilling is taking place. The schematic illustration of FIG. 4 shows the rotary steerable drilling tool 26 connected in the drill string 14 along with a drilling fluid powered thruster T, which is provided to control weight on bit. The thruster is comprised mainly of a hydraulically controlled piston, the lower part of the bottom hole assembly being connected to the piston. The coupling 27 between the rotary steerable drilling tool 26 and the thruster T may be a simple pipe coupling, or a tool section permitting integration of the control features, electronic, hydraulic, or a combination of electronic and hydraulic controls, between the rotary steerable drilling tool and the thruster. If desired, the coupling 27 may take the form of the flexible sub shown in FIGS. 10 and 11. As shown in FIG. 5, a thruster T is connected below the rotary steerable drilling tool 26 and this is positionable in angulated relation with the collar of the drilling tool 26 by adjusting the position of the bit shaft of the tool. In this case, the bit shaft provides support for the thruster while the thruster provides support for the drill bit as well as controlling weight on bit. As shown in FIG. 6, the arrangement of the rotary steerable drilling system 26 and the thruster T is as shown in FIG. 4. Additionally, a mud motor M is connected to the drill string 14 above the thruster to thus provide for rotation of the thruster and the collar of the rotary steerable drilling tool at a speed of rotation that is different from the rotational speed of the drill string, while at the same time controlling weight on bit. The schematic illustration of FIG. 7 shows a mud motor M connected above the rotary steerable drilling tool 26 and shows a thruster T connected in the drill string 14 above the mud motor. If desired, the coupling between either the rotary steerable drilling tool and the mud motor or between the mud motor and the thruster or both may be provided by a flexible sub of the character set forth in FIGS. 10 and 11. FIG. 8 shows the rotary steerable drilling tool connected to the drill string 14 and having a mud motor M connected to the geostationary bit shaft of the tool and thus subject to angulation relative to the tool collar along with the bit shaft. A thruster T is located below the mud motor M for supporting the drill bit and for controlling weight on bit. The thruster T is positioned relative to the collar of the rotary steerable drilling tool 26 by the output shaft of the mud motor M and the mud motor is positioned for controlled steering by the bit shaft of the rotary steerable drilling tool. The schematic illustration of FIG. 9 shows the rotary steerable drilling tool 26 connected to the drill string 14 and having a thruster T supported and oriented by the bit shaft relative to the collar of the tool. A mud motor M is positioned below the thruster so that its output shaft both supports and drives the drill bit. The drill bit is thus steered by the rotary steerable drilling tool and is rotationally driven by both the rotary speed of the drill string and the rotary speed of the mud motor output shaft. This enables the drill bit to be rotated at a speed that is greater than or equal to the rotational speed of the drill string, while at the same time weight on bit is controlled by the thruster.

As shown diagrammatically in FIG. 9, the thruster T may be provided with a control valve D1 in the fluid circuit thereof while a control valve D2 may be provided in the fluid circuit of the mud motor M. These control valves are selectively positioned by the control circuitry of the rotary steerable drilling system, indicated schematically by the line C, to thus permit the thruster and/or the mud motor to be integrated into the control system of the rotary steerable drilling system. In this manner the mud motor and thruster are subject to feedback responsive control in the same manner as the rotary steerable drilling system. The control valve D2 in the mud motor M can be controlled by the rotary steerable drilling system to control the rotary speed of the output shaft of the mud motor and to thus control torque at the drill bit. The control valve D1 of the thruster is selectively positioned by the control system of the rotary steerable drilling system to control weight on bit. Thus, the rotary steerable drilling system of the present invention provides for effective steering of the drill bit and for enhanced drilling characteristics by efficiently controlling torque at the drill bit and controlling weight on bit to thus promote extended reach drilling.

Figure 10:
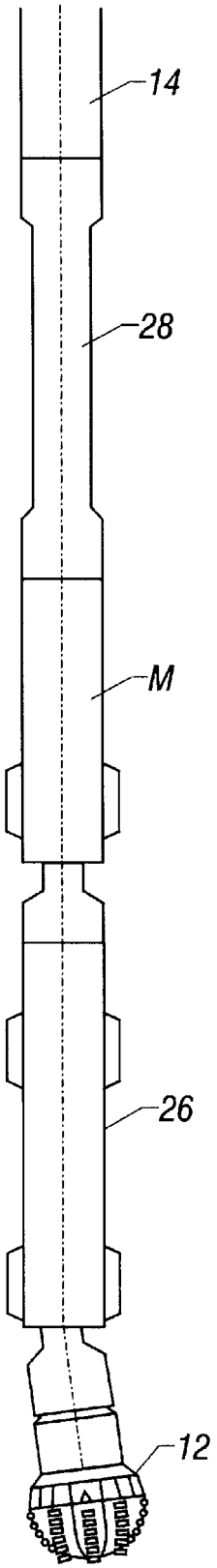
Figure 11:
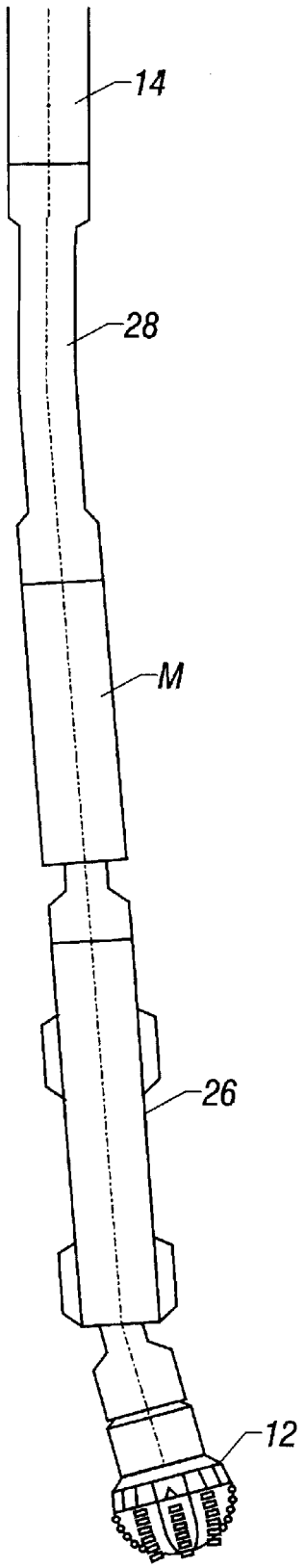

FIGS. 10 and 11 show a drill string 14 having an actively controlled rotary steerable drilling system 26 connected therein for steering a bit shaft having a drill bit 12 connected thereto. The drill string 14 also incorporates a mud motor M for increasing the speed of rotation of the drill bit 12 and a flexible sub 28 for the purpose of enhancing the precision of steering that is accomplished by the rotary steerable drilling system. The flexible sub 28 also accomplishes selective decoupling of the rotary steerable drilling system from the drill string to thus enhance the steering capability thereof.

Referring to FIGS. 12, 14 and 15, an actively controlled rotary steerable drilling system constructed in accordance with the principles of the present invention is shown generally at 26, as mentioned above, and represents the preferred embodiment. The actively controlled rotary steerable drilling system 26 has a tubular collar 32 which at its upper end defines an internally threaded section 34 enabling its connection directly to the flexible sub 28 or to the rotary output shaft of a mud motor and thruster, depending upon the manner by which the steerable drilling tool 26 is to be employed. Referring to the alternative embodiment of FIG. 14, within the upper portion of the collar 32 there is provided an electromagnetic induction system 36 and an electrical wire communication link 38 to provide for communication of signals from the rotary steerable drilling tool 26 to an uphole MWD system to send downhole data back to the surface in real time and to facilitate communication of control signals from drilling control equipment at the surface to the tool during drilling operations. The collar 32 also defines an electronics and sensor support section 40 having therein various sensor equipment. The support section 40 may define a receptacle 42 within which is located a magnetometer, accelerometer, and gyroscopic sensor having the capability of providing electronic output signals that are utilized dynamically for steering of the tool. A number of electronic components of the actively controlled rotary steerable drilling system 26 may also be incorporated within the electronics and sensor support section 40. For example, a formation resistivity measurement system 41 may be located within the collar 32 for rotation along with the collar and will incorporate vertically spaced transmitters and receivers to enable electromagnetic signals to determine formation resistivity. The method and apparatus for measuring resistivity of the earth formation being drilled, and to do so while rotary drilling operations are in progress, may conveniently take the form that is set forth in U.S. Pat. No. 5,594,343, which patent is incorporated herein by reference. The apparatus and electronics of the resistivity measurement system may rotate with the collar 32 or it may rotate with other components of the actively controlled rotary steering tool. The system for resistivity measurement may also be physically located at any other desired location within the tool 26 as desired to enhance manufacture or use of the rotary steerable drilling system. Various other sensing and measuring systems may also be incorporated within the electronics and sensor support section 40, including, for example, a gamma ray measurement system or a sonic imaging system. The drilling tool 26 may also incorporate rotational speed sensing equipment, bit shaft vibration sensors and the like. Additionally, electronic data processing systems may also be included within the electronics package of the tool for receiving and processing various data input thereto and providing signal output that is used for steering control and for controlling other factors encountered during well drilling. The electronic data processing systems may be selectively located within the tool so as to be rotatable along with the tool collar or counter-rotatable within the tool collar along with the bit shaft and its operational components.

As shown in FIGS. 12 and 14, immediately above or below the electronics and sensor support section 40 there is provided a fluid energized turbine mechanism shown generally at 48 having a stator 50 which is preferably disposed in fixed relation with the tubular collar 32 and a rotor 52 that is mounted for rotation relative to the stator 50. As shown in FIG. 13, the relative positions of the rotor 52 and stator 50 are adjustable, either or both of the rotor and stator may be subject to position controlling movement, for the purpose of controllably varying the efficiency and thus the power output of the turbine 48. The rotor 52 is provided with a turbine output shaft 54 which is disposed in driving relation with an alternator 56 via a transmission 58. Since the turbine output shaft 54 is connected in driving relation with the transmission 58, turbine efficiency control can be achieved by mounting the stator 50 so as to be controllably movable by the drilling system electronics responsive to turbine output demand. The turbine may also be braked electrically to limit free spin thereof, thus increasing the power that is available from the turbine. The heat that is developed during such electric braking will be dissipated efficiently by the drilling fluid which flows through the tool. The drilling fluid flow through the tool also serves to cool the various internal components of the tool, such as the electronics package, the alternator and the bit shaft positioning motor. In one embodiment of the present invention the alternator 56, as shown in FIG. 14, functions as resistance to turbine output and because of its resistance, the alternator 56 is utilized as an electromagnetic brake. In accordance with the preferred embodiment of this invention, the alternator 56 is provided with a transmission mechanism 58 which permits the turbine 48 to operate at optimum rotational velocity for efficient operation of the alternator. The alternator 56 provides an electrical output that is electrically coupled with the operational and control circuitry of an electric motor 60 so that the electrical energy generated by the turbine driven alternator 56 is employed to drive the electric motor 60.

A gear box or transmission 61 driven by the electric motor 60 has its rotary output connected in driving relation with an offsetting mandrel 62 which is rotatably driven by the internal rotor of the electric motor 60 and to which is fixed a rotary drive head 64 having an eccentrically located positioning receptacle 66 therein which receives an end 68 of a bit shaft 70. The offsetting mandrel 62 and the rotary drive head 64 are counter-rotated with respect to the rotation of the collar 32 to maintain the axis of the bit shaft 70 geostationary during drilling. The bit shaft 70 is mounted for rotation within the tubular collar 32 intermediate its extremities for omnidirectional movement about a pivot-like universal joint 72 which is preferably of the ball pivot configuration and function shown in FIGS. 17 and 19 and described below, and if desired, may be of the splined configuration shown in FIGS. 21 and 25, also described in detail below. Certain components of the electronic data processing systems may be located geostationary in the rotary drive head 64. For example, the accelerometers, magnetic sensors and gyroscopic sensor may be located in the rotary drive head 64. An inclination sensor is located on the rotary drive head 64 to thereby provide a measurement reflecting the position of the drive head within the borehole.

To permit accuracy of downhole steering of the rotary steerable drilling system, the precise position of the rotary components of the drilling tool establish a known position index from which steering correction is determined. As such, it is desirable that position indicating sensors be located in geostationary relation with respect to the rotary drive system for the bit shaft. Accordingly, the rotary drive head 64 of the offsetting mandrel 62 may be provided with various position indicators, such as accelerometers, magnetometers, and gyroscopic sensors which are disposed in fixed relation with the rotary drive head 64 or any other component that is rotatable concurrently therewith. These position indicating components eliminate the need for precision location of the drill string and the collar 32 of the rotary steerable drilling system 26 as the drilling operation progresses and facilitate real time position signal feedback to the signal processing package of the drilling system so that tracking corrections can be established automatically by the control system of the rotary steerable drilling system to maintain the desired course of the drill bit.

Referring now to the schematic illustration of FIG. 14, an alternative embodiment of the present invention is shown generally at 26A, wherein like components, as compared to the embodiment of FIG. 12, are shown by like reference numerals. It should be borne in mind that the basic difference in the embodiments of FIGS. 12 and 14 is the location of the turbine 48 and alternator 56 with respect to the electronics and sensor support section 40 of the rotary steerable drilling system 26. Within the tubular tool collar 32, as shown in FIG. 14, the electronics and sensor support section 40 is located above the turbine 48. The stator 50 and rotor 52 of the turbine 48 of FIG. 14 can be relatively adjustable, with the stator 50 preferably being linearly movable within the collar 32 relative to the rotor 52 to adjust the efficiency and thus the power output of the turbine. The turbine output shaft 54 is connected in driving relation with an alternator 56 which may have a transmission 58 for permitting the turbine and alternator to run at appropriate speeds for optimum torque output. The heat that is generated by motor operation and braking and by the system electronics will be continually dissipated by the drilling fluid that flows continuously through the rotary steerable drilling system. The alternator 56 powers an electric motor 60. The output shaft of the electric motor 60 functions as an offsetting mandrel 62 and is provided with a rotary drive head 64 having a positioning receptacle 66 located eccentrically therein and receiving the driven end 68 of a bit shaft 70 for rotating the bit shaft about its universal joint support 72 in the manner described above in connection with the preferred embodiment of FIG. 12. With regard to the omnidirectional or universal joint support 72 for the bit shaft 70, it should be borne in mind that the omnidirectional or universal joint support may be of the ball type as shown in FIGS. 17 and 19, or of the splined type as shown in FIGS. 21 and 25.

Referring now to the schematic illustration of FIG. 15, another alternative embodiment of the present invention is shown generally at 26B, wherein like components, as compared to the embodiment of FIG. 12, are also shown by like reference numerals. The rotary steerable drilling system 26B incorporates an elongate, tubular tool collar 32 which is adapted for connection to a drill string or rotary components of a drill string so that the tool collar 32 is rotated during well drilling operations. Within the tool collar 32 a turbine, shown generally at 48 is mounted and includes a rotor and stator assembly, with the rotor being driven by drilling fluid flow 49 through the tool collar. As shown schematically, the electronics and sensors and the brake mechanism 35 of the rotary steerable drilling system are secured within the tool collar 32 by mounting elements 33 so that an annulus 37 exists which defines a flow path through which drilling fluid is allowed to flow. Heat that is developed in the electronics and sensors and brake mechanism 35 during operation is carried away by the drilling fluid that flows continuously through the rotary steerable drilling system 26B. The rotor of the turbine imparts driving rotation to a drive shaft which is rotated at a speed that is optimum for turbine operation, though typically excessive for offsetting mandrel and bit shaft rotation and having a torque output that is insufficient for geostationary bit shaft axis positioning. Thus, a gear train 39, also centrally mounted within the tool collar 32, has its input mechanism connected to the turbine driven shaft and has its output connected to impart driving rotation to an offsetting mandrel 62. The offsetting mandrel 62, in the same manner as is shown in FIG. 14, is provided with a rotary drive head 64 defining an eccentric positioning receptacle 66 which receives the upper end 68 of a universally rotatable bit shaft 70. The bit shaft 70 is mounted within the tool collar 32 by a universal joint 72 in the manner and for the purpose described above.

Referring now to FIG. 16, it should be borne in mind that the scope of the present invention is intended to encompass rotary steerable drilling tools having hydraulically powered offsetting mandrel rotational control and bit shaft positioning control as well as turbine/alternator powered motor control as presented in the embodiments of FIGS. 12 and 14. As shown in FIG. 16, a turbine 48 is mounted within the tool collar 32 and incorporates a stator 50 and rotor 52, with the output shaft 54 of the rotor coupled in driving relation with a hydraulic pump 53. The turbine 48 may be mounted within the tool collar 32 above the electronics and sensor support section 40 as shown, or below this section. A hydraulic motor 55 is mounted within the tool collar 32 and is operated by pressurized hydraulic fluid from the pump 53 for driving the offsetting mandrel 62. If desired, the hydraulic motor 55 may incorporate a braking system or have a braking system in combination therewith so as to function as a motor and brake in the manner and for the purpose described herein. Additionally, the rotary output of the hydraulic motor 55 may be altered by a gear box 57 so as to provide the desired rotational speed and power for efficient steering while drilling.

With reference now to FIGS. 17 and 18, the mechanism of the actively controlled rotary steerable drilling tool 26 of FIG. 12 is shown in detail and represents the preferred embodiment of this invention. Within the lower end of the tubular tool collar 80 there is defined a bit shaft support receptacle 82 which is defined by a tubular extension 84 of the tool collar 80. Within the receptacle 82 is located a tubular sleeve 86 having a thrust ring 90 which is spring loaded against a bit shaft rotation ring 94 and defines a spherical surface segment 92. Bit shaft rotation ring 94 is positioned about the bit shaft 96 and defines a corresponding spherical surface segment 98 that is in supported engagement with the spherical surface segment 92 of the thrust ring 90, thus causing the thrust ring 90 to transfer thrust force from the bit shaft rotation ring 94 to the tubular tool collar 80 while at the same time allowing the bit shaft to pivot about the pivot point 99 about which the spherical surface segment 92 is generated. A segmented retainer 97 is positioned within a circular retainer groove 101 of the bit shaft 96 and is secured within the circular retainer groove 101 by an overlying circular section of the bit shaft rotation ring 94. A second thrust ring 100 is positioned about the bit shaft 96 and defines a spherical surface segment 106, in turn centered about pivot point 99, facing in the same direction as the spherical surface segment 92 of the thrust ring 90. The second thrust ring 100 defines a planar thrust transmitting shoulder surface 102 which is disposed in thrust transmitting engagement with the bit shaft rotation ring 94 and with the segmented retainer 97. A second bit shaft rotation ring 104 is positioned about the bit shaft 96 and defines a spherical surface segment 107 that is concentric with the spherical surface segment 98 and is disposed in thrust force transmitting engagement with the spherical surface segment 106 of the thrust ring 100 so as to permit rotation of the bit shaft 96 about the pivot point 99 about which both the spherical surface segments 92 and 106 are generated. The bit shaft rotation ring 104 is retained in engagement with the thrust ring 100 by means of a spring that is positioned by a first ball support ring 108. The thrust rings 90 and 100 can change location and diameters with respect to pivot point 99 without departing from the scope of the present invention.

The chain of thrust rings between the tool collar 80 and the bit shaft 96 is a preferred embodiment mechanism which functions to transmit axial forces from the tool collar 80 to the bit shaft 96, and to contain bit shaft 96 axially and radially within shaft support receptacle 82. This bi-directional force transmission embodiment allows for the bit shaft 96 to pivot about the pivot point 99 and permits the axis of the bit shaft to remain geostationary while rotating in a specified direction. Alternative methods of transmitting forces include angular contact radial bearings, which would also allow for pivoting of the bit shaft about pivot point 99, or a combination of tapered thrust rings and angular contact radial bearings which would similarly allow force transmission and pivoting.

The first ball support 108 ring defines a circular groove segment surface 110 having a plurality of pockets in close fitting relation with a plurality of ball bearings 112 that are received within spherical bearing grooves 114 in the bit shaft 96. Ball support ring 108 is rotationally constrained with respect to the tool collar 80 using a plurality of keys or splines as shown at 211 in FIG. 19. A second circular ball support ring 116 is positioned so that a circular groove segment surface 118 thereof defines a plurality of pockets in loose fitting relation with the ball bearings 112 and is also rotationally constrained with respect to the tool collar 80 by splines 211. The second ball support ring 116 is in turn supported by a retainer sleeve 120 which is threadedly secured to the tubular extension 84 of the tool collar 80.

An alternative embodiment for transmitting torque between the collar 182 and the bit shaft 188 is shown in FIG. 25 where collar 182 transmits torque to the bit shaft 188 through flat or circular contact surfaces 301 of bit shaft extensions 300. A plurality of bit shaft extensions 300 can exist, either as integral parts of the bit shaft 188 or as additional pieces retained in the bit shaft.

The combination of ball support ring 108, ball bearings 112 and spherical bearing grooves 114 shown in FIGS. 17 and 19 defines a means of transmitting drilling torque from the tool collar 80 to the bit shaft 96, and in turn to the drill bit. The oversize groove segment surfaces 110 and 118 in ball support rings 108 and 116 allow for pivoting of the bit shaft 96 about the pivot point 99 while at the same time transmitting drilling torque from the tool collar 80 to the bit shaft 96.

Thus, this embodiment transmits thrust and torque loads between the tool collar 80 and the bit shaft 96 while allowing the bit shaft axis to remain geostationary while being rotated by the tool collar 80 to achieve drilling in a selected direction.

At its lower end, the tubular tool collar 80 is provided with means for sealing outside drilling mud from inside lubricating and protecting oil about the universal joint. One suitable means for accomplishing such sealing is a bellows type sealing assembly 126 which creates an effective barrier to exclude drilling fluid from the universal joint assembly while accommodating pivotal movement of the bit shaft 96 relative to the tool collar 80.

Angular positioning of the bit shaft 96 relative to the tubular tool collar 80 is achieved by an eccentric positioning mechanism shown generally at 128 in FIG. 17. The offsetting mandrel 130 is rotatably supported within the tool collar 80 by bearings 142 and is provided with an offsetting mechanism to achieve angular offset of the longitudinal axis of the bit shaft 96 relative to the longitudinal axis of the tool collar 80. A preferred method for creating this offset is shown in FIGS. 22A–D, where the offsetting mandrel is attached rotationally to an outer ring 400 having an offset internal surface 401, this circular internal surface having a centerline at an offset and at an angle to the outside diameter of the inner ring 406 as is more clearly evident in FIG. 22B. In FIG. 22A the offsets from the outer and inner rings subtract, which causes the center of the bit shaft axis 402 (aligned to internal diameter 407 of the inner ring 406) to be aligned with the longitudinal axis of the offsetting mandrel. Consequently, as depicted in FIGS. 22A and 22B, the center 405 of the inner ring (bit shaft) 406 is coincident with the center 404 of the outer ring (offsetting mandrel) 404, thereby causing the rotary steerable drilling tool to drill a straight wellbore.

If inner ring 406 is rotated 180° relative to the outer ring 400 as shown in FIGS. 22C and 22D, then the resulting geometry of the outer and inner rings 400 and 406 adds the offsets of the outer and inner rings, causing the bit shaft axis 402 through point 405 to be at the maximum offset 403 with respect to the outer ring 400, thus locating the bit shaft at its maximum angle with respect to the drill collar to drill in a desired direction. To achieve a lesser angle of the bit shaft with respect to the tool collar than occurs with the ring setting of FIGS. 22C and 22D, the bit shaft positioning rings can have any relative rotational positioning between the ring positions of FIG. 22A and 22B and the ring positions of FIGS. 22C and 22D to thus drill a bore having a lesser degree of curvature being determined by the relative positions of the rings 400 and 406. Thus, the angled relation of the longitudinal axis of the bit shaft with respect to the longitudinal axis of the drill collar is variable between 0° and a predetermined maximum angle depending upon the relative positions of the bit shaft positioning rings. These rings can be rotated with respect to each other by various mechanical or electrical means, including but not limited to a geared motor.

It should also be borne in mind that one of the rings of the offsetting mechanism can be defined by the eccentric receptacle 134 of the concentric drive element 132 at the lower end of the offsetting mandrel 130 as shown in FIG. 17. As the eccentric receptacle 134 of the offsetting mandrel 130 is rotated by the concentric drive element 132 the eccentric receptacle 134 subjects the upper end of the bit shaft 96 to lateral positioning with respect to the axis of rotation of the offsetting mandrel 130 as determined by the relative positions of the rings 400 and 406 of FIGS. 22A–22D, thus causing the bit shaft 96 to be rotated about its universal support so that its longitudinal axis 133 becomes positioned in angular relation with the axis of rotation 135 of the tubular tool collar 80 as shown in FIG. 17. Since the offsetting mandrel drive motor, whether electric, hydraulic or a drive turbine, counter-rotates the tubular drive shaft and the concentric drive element of the offsetting mandrel 130 at the same rotational frequency as that of the tubular tool collar 80, the concentric drive element 132 maintains the longitudinal axis 133 of the bit shaft 96 at a geostationary angle with respect to the axis of rotation of the tubular tool collar 80. Since the tool collar 80 is in direct rotational driving relation with the bit shaft 96, rotation of the tool collar 80 by the drill string or by a mud motor connected to the drill string, causes the bit shaft 96 to rotate the drill bit supported thereby at the angle of inclination and azimuth that is established by such orientation of the bit shaft. This causes the drill bit to drill a curved borehole that is permitted to continue its curvature until such time as a desired borehole inclination has been established. The drilling tool is then controlled by signals from the surface or by feedback signals from its various on-board control systems such that its steering control mechanism is neutralized and the resulting borehole being drilled will continue straight along the selected angle of inclination and azimuth that has been established by the curved borehole. The "ring within a ring" bit shaft adjustment feature facilitates bit shaft angulation adjustment as drilling operations are in progress, without necessitating cessation of drilling or withdrawal of the drilling equipment from the wellbore.

To accommodate pivoting excursion of the bit shaft 96 without interfering with fluid flow through the flow passage 148 of the bit shaft, the offsetting mandrel 130 is provided with an offset flow passage section 150 which directs flowing drilling fluid from the flow passage 152 of the tubular drive shaft and permits unrestricted flow of drilling fluid through the offsetting mandrel 130 even when the bit shaft 96 has been positioned thereby for its maximum angle with respect to the tool collar 80. A tubular pressure compensator 154 is positioned about the offsetting mandrel 130 as shown in FIG. 18 and separates an oil chamber 158 from an annular chamber 159 and is intended to contain a protective oil medium within the oil chamber 158. The pressure compensator 154 is connected and sealed to the lower end 164 of a tubular electronics carrier 166 which is also shown in the cross-sectional illustration of FIG. 20. The tubular electronics carrier 166 defines a weighted section 168 extending circumferentially in the range of about 90 degrees as shown in FIG. 20 and providing for retention of various system control components such as a magnetometer, a gyroscopic device, an accelerometer, a resistivity sensor arrangement and the like. Additionally, the weighted section 168 provides counterbalancing forces during shaft rotation to offset the lateral loads of rotary bit shaft actuation and thus minimize vibration of the rotary steerable drilling tool during its operation. A partial circumferential space 170 is defined internally of the tool collar 80 and externally of the tubular electronics carrier 166 and provides for location of the system electronics 172 of the rotary steerable drilling tool. The system electronics 172 and the various system control components are counter-rotated by the drive motor at the same rotational speed as that of the tool collar 80 so that the electronics and system control components are essentially geostationary during drilling operations.

Referring now to FIG. 21, an alterative embodiment of the present invention having a splined universal joint is shown generally at 180, having a tool collar 182 that is adapted for connection to a drill string for rotation in the manner described above. The tool collar 182 defines an elongate tubular extension 184 which defines an internal receptacle 186 having an omnidirectional drive connection or universal joint located therein for permitting angulation of the bit shaft 188 with respect to the tool collar 182 for geostationary positioning of the bit shaft and drill bit for drilling a curved wellbore. A shoulder within the internal receptacle 186 provides support for a thrust ring 190 having a spherical surface segment 192. A bit shaft rotation ring 194 is located about the bit shaft 188 and defines a spherical surface segment 196 that is disposed in force transmitting and pivotally movable relation with the thrust ring 190. The bit shaft rotation ring 194 defines a circular recess within which is positioned a circular thrust flange 200. A second thrust ring 204, also encompassing the bit shaft 188, is positioned with one axial end thereof disposed in abutment with the circular thrust flange 200 and the bit shaft rotation ring 194. The lower circular face of the second thrust ring 204 is defined by a circular spherical surface segment 206, being a segment of a sphere that is concentric with the spherical surface segment 192. The circular spherical surface segment 206 is engaged by an external upwardly facing spherical surface segment 207 of a lower thrust ring 208 so that positioning of the longitudinal axis of the bit shaft 188 relative to the longitudinal axis of the tool collar 182 occurs about pivot point 209.

Control Architecture

Referring now to FIG. 23, the system control architecture of the rotary steerable drilling system of the present invention is shown by way of block diagram illustration. The system electronics 240 incorporate a programmable electronic memory and processor 242 which is programmed with appropriate algorithms for desired toolface calculation, establishing the borehole curvature that is desired to steer the borehole being drilled to a subsurface zone of interest. The system electronics is programmable downhole and programmable during drilling to enable drilling personnel to selectively steer the drill bit as drilling is in progress.

As steerable well drilling is in progress various data is acquired and input to the system electronics for utilization in toolface calculation. Data from magnetometers 244 provides the system electronics with the position of the tool collar with respect to the earth's magnetic field. Data from one or more gyroscopic sensors 246 provides the system electronics with the angular velocity of the output shaft, i.e., the bit shaft of the rotary steerable drilling system. For purposes of control, the data from the magnetometers and gyroscopic sensors is available to the system electronics by selection of an OR gate circuit 248 which is capable of automatic actuation by the system electronics and selective actuation by control signals from the surface. At least one and preferably a plurality of accelerometers 250 are provided within the rotary steerable drilling system and provide data input to the system electronics that identifies the position of the tool collar in real time with respect to gravity.

Utilizing the various data input from the magnetometers, gyroscopic sensors and accelerometers, the system electronics 240 calculates the instantaneous desired angle between the scribe line of the tool collar and the scribe line of the offsetting mandrel and transmits signals to a motor controller 252 representing the desired angle.

An angular position sensor 260, a resolver for example, is located within the tubular tool collar and is positioned in non-rotatable relation about a portion of the drive shaft of the brushless direct current motor/brake 256 which is capable of rotationally driving the offsetting mandrel or rotationally braking the offsetting mandrel as controlled by the system electronics 240 responsive to various signal input. The purpose of the angular position sensor or resolver 260 is to identify the real time position of the motor/brake shaft at any given point in time relative to the tool collar and to communicate motor/brake position signals to the motor controller 252 via signal conductor 257. It should be borne in mind that the motor shaft is driven in a rotary direction that is counter to the rotation of the tubular tool collar by the drill string to which the tubular tool collar is connected and at the same frequency as the rotational frequency of the tool collar. The angular position sensor or resolver may take the form that is shown and described in U.S. Pat. No. 5,375,098, which is incorporated herein by reference. The output shaft of the motor/brake 256 drives a gear box 262 to thus permit the motor to operate at its optimum rotational speed for desired torque and to permit the output shaft 258 to be rotated in synchronous relation with the speed of tool collar rotation. A switch/trigger 264, such as a Hall effect sensor or other trigger circuit, is provided which, when triggered, provides the actual position of the offsetting mandrel with respect to the tool collar. The signals of the switch/trigger are input to the motor controller 252 via signal conductor 265 to identify the bit shaft position change, if any, that is necessary for the drill bit to follow a programmed curved track during steerable drilling operations. Alternatively, the angular position sensor 260 may be mounted on the output shaft of the gear box 262.

With reference now to FIG. 24, the system control architecture for the alternative embodiment of FIG. 14 is shown wherein the motive force for counter-rotational control of the offsetting mandrel and thus geostationary positioning of the axis of rotation of the bit shaft is achieved by a drilling fluid powered turbine and brake and is controlled in part by controlling the efficiency of the turbine. That portion of the system control architecture, for establishing a control signal representing the desired angle between the scribe line of the tool collar and the scribe or reference line of the offsetting mandrel is substantially of the form that is described above in connection with FIG. 23. This angle control signal is supplied to a brake controller 266 which also receives position signal input via trigger signal conductor 268 from a trigger circuit 270 and via a resolver signal conductor 272 from a resolver 274. The control signal output of the brake controller 266 is supplied to an efficiency control circuit 276 for controlling the efficiency of the turbine 278 and is supplied to a brake 280 for controllably braking the output shaft of the turbine 278 and thus for controlling rotation of the shaft that is sensed by the resolver. To ensure that the turbine rotated and brake controlled shaft, typically the offsetting mandrel, is rotated at the proper speed for efficient positioning control of the bit shaft, a gear box 280 may have its input connected with the turbine driven and braked shaft and may be appropriately geared to drive its output shaft 282 within the desired speed range for efficient bit shaft positioning and efficient curved borehole drilling.

An alternative option is to include within the system a turbine control mechanism capable of modifying the power produced by the turbine by changing its efficiency. As shown at 276 and 278 in the block diagram system control architecture of FIG. 24 and schematically in FIG. 13, this feature can be achieved by housing the rotor 52 of the turbine 48 in a stator 50 defining a conical surface 53, and by moving the stator 50 linearly with respect to the rotor 52, thus defining a selectively variable turbine. The mounting system for the turbine 48 within the rotary steerable drilling tool will cause the stator 50 to be mounted within the tool collar for controlled linear movement responsive to the system electronics and brake controller. The mounting system for the stator is actuated by the control electronics of the drilling tool, i.e., position signal responsive brake controller 266 and efficiency control 276 as shown in FIG. 24, so that its adjustable positioning can be achieved with the drilling tool located downhole and can be achieved while the drilling tool is in operation to effectively maintain rotational speed and torque of the turbine within desired limits for effective operation.

Such a turbine control mechanism would be used to reduce the power output of the turbine at higher flow rates. At lower flow rates the turbine would work at its maximum efficiency to insure that the turbine power is always larger than the resistive power. Since the turbine control mechanism would mainly respond to flow rate variations its response bandwidth need not be very high.

In view of the foregoing it is evident that the present invention is one well adapted to attain all of the objects and features herein set forth, together with other objects and features which are inherent in the apparatus disclosed herein.

As will be readily apparent to those skilled in the art, the present invention may easily be produced in other specific forms without departing from its spirit or essential characteristics. The present embodiments are, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for drilling a well and simultaneously steering a drill bit with an actively controlled rotary steerable drilling system, comprising:

rotating a tool collar connected to a drill string, said tool collar defining a longitudinal axis;

with bit shaft positioning means, pivotally rotating a bit shaft supported within said tool collar for rotational movement about a pivot point within said tool collar and in a direction counter to rotation of said tool collar, said bit shaft being rotatably driven by said tool collar and being adapted for supporting a drill bit;

transmitting steering control signals to said bit shaft positioning means causing synchronous pivotal counter-rotation of said bit shaft by said bit shaft positioning means about said pivot point with respect to rotation of said tool collar, and maintaining said longitudinal axis of said bit shaft substantially geostationary and selectively axially inclined relative to the longitudinal axis of said tool collar during rotation of said bit shaft by said tool collar; and selectively rotationally braking said bit shaft positioning means in reference to external disturbances acting to divert said drill bit from its projected course.

2. The method of claim 1, wherein said transmitting steering control signals comprises:

sensing the location and orientation of said tool collar and the angular position of said bit shaft axis relative to said tool collar and generating real time position signals;

electronically processing said real time position signals and generating said steering control signals; and controlling said bit shaft axis positioning means in respect to said steering control signals.

3. The method of claim 1, wherein said transmitting steering control signals comprises:

transmitting control signals from a surface location to on-board electronics of said rotary steerable drilling system; and controlling said bit shaft axis positioning means in response to said steering control signals.

4. A method for drilling a well and simultaneously steering a drill bit with an actively controlled rotary steerable drilling system, comprising:

rotating a tool collar connected to a drill string, said tool collar defining a longitudinal axis;

with bit shaft positioning means, counter-rotating a bit shaft supported for rotational movement about a pivot point within said tool collar, said bit shaft being rotatably driven by said tool collar and being adapted for supporting a drill bit;

dynamically sensing the angular position of said longitudinal axis of said bit shaft relative to said longitudinal axis of said tool collar, the position of said tool collar with respect to the earth and the orientation of said longitudinal axis of said bit shaft relative to said tool collar and providing position signals; and processing said position signals and developing steering control signals causing synchronous pivotal counter-rotation of said bit shaft about said pivot point by said bit shaft positioning means with respect to rotation of said tool collar for maintaining said longitudinal axis of said bit shaft substantially geostationary and selectively axially inclined relative to the longitudinal axis of said tool collar during rotation of said bit shaft by said tool collar; and selectively rotationally braking said bit shaft positioning means in reference to external disturbances acting to divert said drill bit from its projected course.

5. The method of claim 4, wherein said maintaining said longitudinal axis of said bit shaft comprises:

responsive to said steering control signals, with said bit shaft positioning means selectively positioning said longitudinal axis of said bit shaft at any selected position between 0° and a predetermined angle relative to the longitudinal axis of said tool collar.

6. The method of claim 5, wherein said selectively positioning said longitudinal axis of said bit shaft is accomplished responsive to said steering control signals during drilling.

7. The method of claim 5, further comprising:

selectively rotatably positioning a first ring located eccentrically with the longitudinal axis of an offsetting mandrel in said bit shaft axis positioning means and a second ring located concentrically with the longitudinal axis of said bit shaft, with said first and second rings in inter-engaging and relatively rotatable adjustable relation for establishing a selected angle of said longitudinal axis of said bit shaft with respect to said longitudinal axis of said tool collar.

8. The method of claim 7, further comprising:

selectively changing the relative rotational positions of said first and second rings during drilling and thereby selectively changing the angle of said longitudinal axis of said bit shaft with respect to said longitudinal axis of said tool collar and thus changing the steering course of the wellbore being drilled while drilling is in progress.

9. A method for drilling a wellbore with a rotary steerable drilling system connected to a drill string while simultaneously selectively orienting a drill bit being rotated thereby, comprising:

rotating a tool collar with a rotating drill string, said tool collar defining a longitudinal axis and having a bit shaft pivotally mounted therein, said bit shaft defining a longitudinal axis disposed for omnidirectional pivotal movement relative to said tool collar;

operating a turbine within said tool collar with drilling fluid flowing through said tool collar and rotating an output shaft of said turbine;

driving an alternator with said output shaft of said turbine and producing an electrical output of said alternator;

operating an electric motor with said electrical output of said alternator and with a rotary output shaft of said electric motor driving an offsetting mandrel within said tool collar in synchronous pivotal counter-rotational relation with tool collar rotation and translating rotary motion of said offsetting mandrel into pivotal movement of said bit shaft within said tool collar for geostationary orientation of said longitudinal axis of said bit shaft in selected angular relation with said longitudinal axis of said tool collar for drilling a curved wellbore; and selectively rotationally braking said offsetting mandrel in reference to external disturbances acting to divert said drill bit from its projected course.

10. The method of claim 9, further comprising:

changing the efficiency of said turbine to thus change the power input thereof to said alternator and thus change the electric power input to said electric motor at a given drilling fluid flow rate.

11. The method of claim 9, further comprising:

selectively changing the angle of said longitudinal axis of said bit shaft with respect to said longitudinal axis of said tool collar to any angular relation within a range of angular positioning from 0 for straight wellbore drilling to an angular relation for curved wellbore drilling.

12. The method of claim 11, further comprising:

selectively rotatably positioning a first ring located eccentrically with the longitudinal axis of said offsetting mandrel and a second ring located concentrically with said longitudinal axis of said bit shaft, with said first and second rings in inter-engaging relation for establishing a selected angle of said longitudinal axis of said bit shaft with respect to said tool collar.

13. The method of claim 12, further comprising:

selectively changing the relative rotational positions of said first and second rings during drilling and thereby selectively changing the angle of said longitudinal axis of said bit shaft with respect to said longitudinal axis of said tool collar while rotary drilling is in progress.

14. The method of claim 9, further comprising:

pivotally supporting said bit shaft within said tool collar while maintaining rotary driving relation between said bit shaft and said tool collar; and transmitting between said tool collar and said bit shaft axial forces acting on said bit shaft in either axial direction.

15. The method of claim 9, wherein said rotary steerable drilling system comprises on-board electronics for signal processing and steering control signal generation and said drill string incorporates a system for formation measuring while drilling and formation position sensing, said method further comprising:

conducting formation measuring while drilling and generating formation measuring signals;

conducting formation position sensing for sensing the subsurface position of said rotary steerable drilling system and generating drilling system position signals;

providing real time signal telemetry of said formation measuring signals and subsurface position signals to said on-board electronics of said rotary steerable drilling system;

processing said formation measuring signals and said subsurface position signals in said on-board electronics and generating steering control signals; and controlling said rotational positioning of said offsetting mandrel relative to said bit shaft responsive to said steering control signals.

16. The method of claim 9, wherein said tool collar houses an accelerometer providing signals, said method further comprising:

electronically processing said signals of said accelerometer means to selectively measure the orientation of the longitudinal axis of said tool collar and said longitudinal axis of said bit shaft with respect to the earth's gravity field; and actuating said bit shaft responsive to said processed signals for positioning said longitudinal axis of said bit shaft at a predetermined orientation with respect to the earth's gravity field for controllably steering the drill bit during wellbore drilling.

17. The method of claim 9, wherein said tool collar houses a magnetometer for providing signals, said method further comprising:

electronically processing said signals of said magnetometer to selectively measure the orientation of said longitudinal axis of said tool collar and said longitudinal axis of said bit shaft with respect to the earth's magnetic field; and actuating said bit shaft responsive to said measurement signals for positioning said longitudinal axis of said bit shaft at a predetermined orientation with respect to the earth's magnetic field for controllably steering the drill bit during wellbore drilling.

18. The method of claim 9, wherein said tool collar houses a gyroscopic sensor for providing signals, said method further comprising:

electronically processing said signals of said gyroscopic sensor; and stabilizing said longitudinal axis of said bit shaft responsive to said electronically processed signals of said gyroscopic sensor.

19. The method of claim 9, wherein said tool collar houses an accelerator and a magnetometer for providing signals, said method further comprising:

selectively electronically processing said signals of said accelerator and said magnetometer with respect to a predetermined toolface angle and providing control signals representing a bit shaft axis deviation angle; and actuating said bit shaft responsive to said control signals for positioning said longitudinal axis of said bit shaft at a selected bit shaft axis deviation angle for controllably steering the drill bit during wellbore drilling.

20. The method of claim 9, wherein said tool collar having an accelerometer, a magnetometer and a gyroscopic sensor for providing position indicating signals, said method further comprising:

selectively electronically processing said signals of said accelerometer, said magnetometer and said gyroscopic sensor and providing control signals representing bit shaft axis deviation angle; and actuating said bit shaft responsive to said control signals for positioning said longitudinal axis of said bit shaft at a selected bit shaft axis shaft deviation angle for controllably steering the drill bit during wellbore drilling.

21. The method of claim 9, wherein said tool collar houses a magnetometer and a gyroscopic sensor providing position indicating signals, said method further comprising:

selectively electronically processing said position indicating signals of said magnetometer and said gyroscopic sensor and providing control signals representing bit shaft axis deviation angle; and actuating said bit shaft responsive to said control signals for positioning said longitudinal axis of said bit shaft at a selected bit shaft axis deviation angle for controllably steering the drill bit during wellbore drilling.

22. The method of claim 9, wherein said tool collar houses therein system electronics for processing position indicating signals and generating bit shaft axis angle control signals, and position indicating sensors, said method further comprising:

conducting signal telemetry between said system electronics and position indicating sensors of said tool collar during well drilling; and processing said signal telementry for generation of bit shaft steering signals during well drilling.

23. The method of claim 22, further comprising:

maintaining at least some of said position indicating sensors and at least a part of said system electronics in substantially geostationary position during rotation of said tool collar by said drill string.

24. The method of claim 22, further comprising:

maintaining at least some of said position indicating sensors in fixed relation with said offsetting mandrel during rotation of said tool collar.

25. The method of claim 22, further comprising:

maintaining at least some of said position indicating sensors in fixed relation with said bit shaft during rotation of said tool collar.

26. The method of claim 9, wherein said tool collar houses system electronics therein for processing position indicating signals and generating bit shaft steering angle control signals, and position indicating sensors, said method further comprising:

conducting signal telemetry between said system electronics and position indicating sensors of said tool collar by means of inductive coupling during well drilling for generation of bit shaft position signals during well drilling; and processing said bit shaft position signals by said system electronics and providing steering control signals for selectively positioning said longitudinal axis of said bit shaft relative to said longitudinal axis of said tool collar.

27. The method of claim 9, wherein said tool collar houses system electronics therein for processing position indicating signals and generating bit shaft angle control signals, and position indicating sensors, said method further comprising:

conducting signal telemetry between said system electronics and position indicating sensors of said tool collar by electrical contacts during well drilling for generation of bit shaft axis position control signals during well drilling.

28. The method of claim 9, wherein said tool collar houses therein system electronics for processing position indicating signals and generating bit shaft axis angle control signals, and position indicating sensors, said method further comprising:

maintaining at least some of said position indicating sensors and at least a part of said system electronics substantially geostationary during drilling.

29. The method of claim 9, wherein a measuring while drilling system is located in said drill string, and system electronics and position sensors are located within said rotatable tool collar, said method further comprising:

conducting inductive transmission between said system electronics and position sensors within said rotatable tool collar and said measuring while drilling system.

30. The method of claim 9, wherein a measuring while drilling system is located in said drill string, and system electronics and position sensors are located within said rotatable tool collar, and wherein a flexible sub is interposed in said drill string between said rotatable tool collar and said measuring while drilling system, said method further comprising:

conducting inductive signal telemetry around said flexible sub and between said system electronics and said position sensors of said rotatable tool collar and said measuring while drilling system.

31. The method of claim 9, further comprising:

conducting control signals to said rotary steerable drilling system via flowing drilling fluid by selectively varying the flow rate of the drilling fluid flowing through said rotary steerable drilling system.

32. A method for drilling a wellbore with a rotary steerable drilling system connected to a drill string while simultaneously selectively orienting a drill bit being rotated thereby, comprising:

rotating a tool collar with a rotating drill string, said tool collar defining a longitudinal axis and having a bit shaft pivotally mounted therein, said bit shaft defining a longitudinal axis disposed for omnidirectional pivotal movement relative to said tool collar;

operating a turbine within said tool collar with drilling fluid flowing through said tool collar and rotating an output shaft of said turbine;

driving an alternator with said output shaft of said turbine and producing an electrical output of said alternator;

operating an electric motor with said electrical output of said alternator and with a rotary output shaft of said electric motor driving an offsetting mandrel within said tool collar in synchronous pivotal counter-rotational relation with tool collar rotation, said offsetting mandrel defines an eccentric receptacle having at least one eccentric ring therein and said bit shaft is engaged within said eccentric ring and translating rotary motion of said offsetting mandrel into pivotal movement of said bit shaft within said tool collar for geostationary orientation of said longitudinal axis of said bit shaft in selected angular relation with said longitudinal axis of said tool collar for drilling a curved wellbore; and selectively adjusting the relative position of said eccentric ring with respect to said eccentric receptacle for selectively establishing said angular relation of said longitudinal axis of said bit shaft relative to said longitudinal axis of said tool collar at a selected angle between 0 and a predetermined angle.

33. A method for drilling a wellbore with a rotary steerable drilling system while simultaneously selectively orienting a drill bit being rotated by a rotatable tool collar of said rotary steerable drilling system, said tool collar defining a longitudinal axis and connected for rotation by a drill string of well drilling equipment, comprising:

rotating said tool collar having a bit shaft mounted therein for pivotal movement relative to said tool collar, said bit shaft defining a longitudinal axis and being rotatably driven by said tool collar;

counter-rotating an offsetting mandrel within said tool collar, said offsetting mandrel having an offset driving connection with said bit shaft and translating rotary motion of said offsetting mandrel into rotary pivoting of said bit shaft about a pivot point within said tool collar;

applying braking for maintaining said longitudinal axis of said bit shaft geostationary and in predetermined angular relation with said longitudinal axis of said tool collar; and selectively orienting said longitudinal axis of said bit shaft in angular relation with said longitudinal axis of said tool collar for causing the drill bit to drill a curved wellbore in a selected direction.

34. A method for drilling a wellbore with an actively controlled rotary steerable drilling system, comprising:

rotating a tool collar connected to a drill string, said tool collar defining a longitudinal axis;

imparting driving rotation to a bit shaft pivotally supported by said tool collar for pivotal movement of the longitudinal axis thereof about a pivot point relative to the longitudinal axis of said tool collar;

driving a turbine mounted within said tool collar by drilling fluid flow through said tool collar, said turbine having rotary driving connection with an offsetting mandrel mounted for rotation within said tool collar, said offsetting mandrel imparting pivotal counter-rotation to said bit shaft at the same rotary frequency as rotation of said tool collar and establishing a selected angular relation of said longitudinal axis of said bit shaft with said longitudinal axis of said tool collar; and selectively applying braking force for maintaining said longitudinal axis of said bit shaft substantially geostationary and selectively axially inclined with respect to said longitudinal axis of said tool collar for selectively steering said drill bit and the wellbore being drilled thereby.

35. The method of claim 34, further comprising:

sensing the position of said tool collar with respect to the earth and the orientation of said longitudinal axis of said bit shaft relative to said longitudinal axis of said tool collar and providing position signals;

processing said position signals by system electronics of said rotary steerable drilling system for generation of steering control signals; and transmitting said steering control signals to said offsetting mandrel causing synchronous pivotal counter-rotation of said bit shaft axis about said pivot point with respect to rotation of said tool collar and maintaining said longitudinal axis of said bit shaft substantially geostationary and selectively axially inclined relative to said longitudinal axis of said tool collar during rotation of said bit shaft by said tool collar.

36. The method of claim 34, wherein said turbine is in rotary driving relation with an alternator, said braking being electromagnetic braking, and further comprising:

rotationally driving said alternator with said turbine, said alternator generating electrical current responsive to said rotational driving thereof and generating heat responsive to resistive load; and dissipating heat from said alternator by drilling fluid flowing about said alternator.

37. An actively controlled rotary steerable drilling system for well drilling, comprising:

a tool collar being adapted for connection to a drill string for rotation by the drill string and defining a longitudinal axis;

a bit shaft being supported within said tool collar for pivotal movement about a pivot point and being rotatably driven by said tool collar, said bit shaft defining a longitudinal axis and being adapted for supporting a drill bit;

a bit shaft position sensor within said tool collar for dynamically sensing the angular position of said longitudinal axis of said bit shaft relative to said longitudinal axis of said tool collar and providing bit shaft position signals;

system electronics processing said bit shaft position signals of said bit shaft position sensor and causing synchronous pivotal counter-rotation of said bit shaft about said pivot point with respect to rotation of said tool collar and maintaining said longitudinal axis of said bit shaft substantially geostationary and selectively axially inclined relative to the longitudinal axis of said tool collar during rotation of said bit shaft by said tool collar; and a brake within said tool collar for applying a braking force for maintaining said longitudinal axis of said bit shaft substantially geostationary and selectively axially inclined with respect to said longitudinal axis of said tool collar for selectively steering said drill bit and the wellbore being drilled thereby.

38. The actively controlled rotary steerable drilling system of claim 37, further comprising:

an offsetting mandrel being rotatable within said drilling tool collar and having offsetting driving relation with said bit shaft for imparting rotary pivotal movement to said bit shaft about a pivot point within said tool collar; and a drive motor imparting counter-rotation to said offsetting mandrel at the same frequency of rotation as the rotation of said tool collar.

39. The actively controlled rotary steerable drilling system of claim 38, wherein:

said offsetting mandrel defines a longitudinal axis coincident with said longitudinal axis of said tool collar and has a variable drive connection with said bit shaft for selectively adjusting the angular relation of said longitudinal axis of said bit shaft with respect to said longitudinal axis of said tool collar within an angular range between 0 and a predetermined angle.

40. The actively controlled rotary steerable drilling system of claim 39, further comprising:

position measurement sensors providing position signals representing the real time position of said tool collar and the angular position of said bit shaft relative to said tool collar during rotation of said tool collar and said bit shaft; and electronic signal processing circuitry processing said position signals and providing correction signals when the angular position of said bit shaft relative to said tool collar is beyond permissible limits; and a bit shaft positioning mechanism being responsive to said correction signals for adjusting the angular position of said bit shaft relative to said tool collar to return said bit shaft to a position within permissible limits relative to said tool collar.

41. The actively controlled rotary steerable drilling system of claim 39, wherein said variable drive connection comprises:

said offsetting mandrel defining a bit shaft drive receptacle receiving an end of said bit shaft and being eccentric with said longitudinal axis;

a pair of interengaging eccentric rings being located within said bit shaft drive receptacle with one of said interengaging eccentric rings being in force transmitting contact with said bit shaft and the other of said interengaging eccentric rings being in contact with said bit shaft drive receptacle, said interengaging eccentric rings being relatively positionable for establishing angular positioning of said axis of rotation of said tool collar and said longitudinal axis of said bit shaft; and means for selectively positioning said interengaging eccentric rings.

42. The actively controlled rotary steerable drilling system of claim 38, wherein said means imparting rotation to said offsetting mandrel comprises:

a rotary motor within said tool collar and being in rotary driving relation with said offsetting mandrel;

a drilling fluid energized power source within said tool collar providing power for driving said rotary motor; and a motor control for controlling operation of said rotary motor based on real-time measurement of the rotary and angular position of said bit shaft relative to said tool collar.

43. The actively controlled rotary steerable drilling system of claim 42, wherein said motor control comprising:

a position based control loop is integrated with said actively controlled rotary steerable drilling system and said system includes magnetometers, accelerometers and gyroscopic sensors transmitting position indicating signals; and system electronics processing said position indicating signals and providing motor control signal output for controlling operation of said rotary motor.

44. The actively controlled rotary steerable drilling system of claim 42, wherein:

said rotary motor is an electric motor; and said drilling fluid energized power source is a turbine driven alternator located within said drilling tool collar providing an electric current output connected in operating relation with said electric motor.

45. The actively controlled rotary steerable drilling system of claim 42, wherein:

said rotary motor is an electric motor; and said drilling fluid energized power source being a turbine driven alternator located within said drilling tool collar providing an electric current output connected in operating relation with said electric motor; and said brake selectively applying rotary braking force to said offsetting mandrel.

46. The actively controlled rotary steerable drilling system of claim 42, wherein:

said rotary motor is a hydraulic motor having driving capability for rotating said offsetting mandrel and having rotary braking capability for applying rotary braking force to said offsetting mandrel; and said drilling fluid energized power source is a drilling fluid driven turbine located within said drilling tool collar providing a rotary power output connected in rotary driving relation with a hydraulic pump.

47. The actively controlled rotary steerable drilling system of claim 37, wherein:

a universal joint is located within said tool collar and supports said bit shaft for pivotal movement relative to said tool collar; and said universal joint has force transmitting support means permitting pivotal movement of said bit shaft about said pivot point located coincident with said longitudinal axis of said tool collar and transmitting forces from said bit shaft to said tool collar and from said tool collar to said bit shaft.

48. The actively controlled rotary steerable drilling system of claim 47, further comprising:

spaced seals in sealing engagement with said tool collar and said bit shaft and defining a sealed internal chamber within which said universal joint is located; and a protective and lubricating fluid medium being located within said sealed internal chamber and protecting and lubricating said universal joint.

49. The actively controlled rotary steerable drilling system of claim 48, wherein:

one of said spaced seals is a bellows seal member of tubular configuration having one end thereof sealed to said tool collar and the other end thereof sealed to said bit shaft, said bellows seal member separating said internal chamber from the drilling fluid in the well being drilled.

50. The actively controlled rotary steerable drilling system of claim 37, wherein a universal joint pivotally supporting said bit shaft is located within said tool collar, said universal joint comprising:

ball support structure located within said tool collar defining internal pockets;

said bit shaft defining external pockets disposed for registry with said internal pockets; and a plurality of pivot ball elements being engaged within said internal pockets and said external pockets and supporting said bit shaft for pivotal movement of the longitudinal axis thereof between 0 and a predetermined angle relative to the longitudinal axis of said tool collar and about a pivot point within said tool collar and coincident with said longitudinal axes of said bit shaft and said tool collar.

51. The actively controlled rotary steerable drilling system of claim 50, further comprising:

at least one thrust force transmission ring interposed between said bit shaft and said tool collar and defining spherical surface generated about said pivot point, said thrust force transmission ring permitting pivotal movement of said bit shaft within said tool collar and simultaneously transmitting forces between said bit shaft and said tool collar.

52. The actively controlled rotary steerable drilling system of claim 51, wherein said at least one thrust force transmission ring comprises:

a first thrust ring interposed between said bit shaft and said tool collar in thrust force transmitting relation with said tool collar, said first thrust ring defining a concave spherical surface segment oriented about said pivot point;

a first bit shaft rotation ring interposed between said bit shaft and said tool collar and defining a convex spherical surface segment in arcuately movable engagement with said concave spherical surface segment of said first thrust ring;

a first retainer in force transmitting relation with said bit shaft and securing said first thrust ring and said bit shaft rotation ring in force transmitting relation with said tool collar and said bit shaft;

a second thrust ring interposed between said tool collar and said bit shaft and being in force transmitting relation with said retainer, said second thrust ring defining a concave spherical surface segment oriented about said pivot point;

a second bit shaft rotation ring interposed between said tool collar and said bit shaft and defining a convex spherical surface segment in arcuately movable force transmitting engagement with said concave spherical surface segment of said second thrust ring; and a retainer element retaining said second thrust ring and said second bit shaft rotation ring in fixed relation with respect to said tool collar.

53. The actively controlled rotary steerable drilling system of claim 37, further comprising:

at least one magnetometer located within said tool collar providing electronic output signals for dynamically steering said drilling system by selectively orienting said bit shaft during rotation thereof by said tool collar.

54. The actively controlled rotary steerable drilling system of claim 37, further comprising:

a gyroscopic sensor located within said tool collar providing electronic signals for pointing said bit shaft at a desired angle for a period of time.

55. The actively controlled rotary steerable drilling system of claim 37, further comprising:

said tool collar having a reference; and an accelerometer located within said tool collar providing electronic signals representing the angle between said reference of said tool collar and the gravity field.

56. The actively controlled rotary steerable drilling system of claim 37, further comprising:

an electronic control system located within said tool collar rotatable by said tool collar during drilling.

57. The actively controlled rotary steerable drilling system of claim 37, further comprising:

a thruster connected in said drill string adjacent said tool collar and actuated responsive to control signals of said rotary steerable drilling system for controlling weight on bit during operation of said rotary steerable drilling system.

58. The actively controlled rotary steerable drilling system of claim 57, further comprising:

system electronics located within said tool collar and having programmable thruster control circuitry; and a drilling fluid control valve located within said thruster and controllably coupled with said system electronics, said control valve being selectively actuated by said system electronics for controlling drilling fluid actuation of said thruster and for minimizing stick-slip of said drill bit and for controlling drill bit speed during drilling.

59. The actively controlled rotary steerable drilling system of claim 58, wherein:

said system electronics comprises programmable circuitry programmable with the complete well profile of the well being drilled and providing said actively controlled rotary steerable drilling system with geosteering capability downhole to permit use of said actively controlled rotary steerable drilling system for drilling the entire deviated section of the wellbore.

60. The actively controlled rotary steerable drilling system of claim 37, further comprising:

a mud motor connected within said drill string above said tool collar establishing a different speed of rotation of said tool collar as compared with the speed of rotation of said drill string.

61. The actively controlled rotary steerable drilling system of claim 60, further comprising:

system electronics within said tool collar;

a control valve located within said mud motor and controllably coupled with said system electronics, said control valve being selectively actuated by said system electronics for controlling drilling fluid actuation of said mud motor.

62. The actively controlled rotary steerable drilling system of claim 37, further comprising:

a mud motor connected within said drill string below said tool collar establishing a different speed of rotation of said drill bit as compared with the speed of rotation of said drill string and said tool collar.

63. The actively controlled rotary steerable drilling system of claim 37, further comprising:

a thruster connected in said drill string adjacent said tool collar and controlling weight on bit during operation of said rotary steerable drilling system; and a mud motor connected within said drill string establishing a different speed of rotation of said drill bit compared with the speed of rotation of said drill string.

64. The actively controlled rotary steerable drilling system of claim 63, further comprising:

system electronics within said tool collar; and control valves within the fluid circuits of said thruster and said mud motor controllably actuated by said system electronics for controlling the efficiency of said thruster and said mud motor for adjustment of weight on bit, rotational speed of said bit shaft and thus torque on said bit shaft and said drill bit.

65. The actively controlled rotary steerable drilling system of claim 37, further comprising:

a flexible sub connected in said drill string adjacent said tool collar for enhancing the accuracy of angular positioning of said bit shaft relative to said tool collar.

66. The actively controlled rotary steerable drilling system of claim 37, further comprising:

a measurement sensor located near said drill bit, said measurement sensor permitting position sensing and measurement close to said drill bit and facilitating drilling system controlled steering decisions downhole.

67. The actively controlled rotary steerable drilling system of claim 37, further comprising:

an accelerometer integrated with said bit shaft providing positioning signals reflecting inclination of said bit shaft during drilling.

68. The actively controlled rotary steerable drilling system of claim 37, further comprising:

means for controlling speed and/or torque in response to control signals of said rotary steerable drilling system during drilling.

69. The actively controlled rotary steerable drilling system of claim 68, wherein the controlling means comprises a mud motor.

* * * * *